US009759097B2

(12) United States Patent
Zampieri

(10) Patent No.: US 9,759,097 B2
(45) Date of Patent: Sep. 12, 2017

(54) CLOSED-CYCLE PLANT

(71) Applicant: ELETTROMECCANICA VENETA S.R.L., Negrar (IT)

(72) Inventor: Gino Zampieri, Guastalla (IT)

(73) Assignee: Elettromeccanica Veneta S.R.L., Negrar (IT)

( * ) Notice: Subject to any disclaimer, the term of this patent is extended or adjusted under 35 U.S.C. 154(b) by 153 days.

(21) Appl. No.: 14/775,523

(22) PCT Filed: Mar. 11, 2014

(86) PCT No.: PCT/IB2014/059635

§ 371 (c)(1),
(2) Date: Sep. 11, 2015

(87) PCT Pub. No.: WO2014/141072

PCT Pub. Date: Sep. 18, 2014

(65) Prior Publication Data

US 2016/0032786 A1 Feb. 4, 2016

(30) Foreign Application Priority Data

Mar. 12, 2013 (IT) ..... MI2013A0375

(51) Int. Cl.
*F01K 15/00* (2006.01)
*F01K 23/10* (2006.01)
(Continued)

(52) U.S. Cl.
CPC ..... *F01K 15/00* (2013.01); *F01K 11/02* (2013.01); *F01K 13/02* (2013.01); *F01K 23/10* (2013.01);
(Continued)

(58) Field of Classification Search
CPC ..... F01K 15/00; F01K 23/10; F01K 11/02; F01K 13/02; F01K 25/08; F01L 15/08; F01L 33/02
(Continued)

(56) References Cited

U.S. PATENT DOCUMENTS 2,726,646 A 12/1955 Black
3,651,641 A * 3/1972 Ginter ..... F02B 47/02 60/39.26
(Continued)

FOREIGN PATENT DOCUMENTS

DE 10 2011 121 274 8/2012
FR 2 914 696 10/2008
(Continued)

OTHER PUBLICATIONS

International Search Report cited in PCT/IB2014/059635, mailed Jun. 14, 2014, eleven pages.

*Primary Examiner* — Hoang Nguyen
(74) *Attorney, Agent, or Firm* — Nixon & Vanderhye P.C.

(57) ABSTRACT

A closed cycle plant for converting thermal power to mechanical or electrical power including: a closed circuit inside which a working fluid circulates according to a predetermined circulation direction, a volumetric expander configured to receive at the inlet the working fluid in a gaseous state. The volumetric expander includes: a jacket having an inlet and an outlet for enabling the introduction and discharge the working fluid; an active element housed in said jacket and suitable for defining, in cooperation with said jacket, a variable volume expansion chamber; a main shaft; a valve active that opens and closes the inlet and outlet, and a generator connected to the main shaft. The valve includes
(Continued)

a regulation device configured to vary the duration of the introduction condition, or the maximum through cross-section of the inlet.

22 Claims, 13 Drawing Sheets

(51) Int. Cl.
*F01K 13/02* (2006.01)
*F01K 25/08* (2006.01)
*F01K 11/02* (2006.01)
*F01L 15/08* (2006.01)
*F01L 33/02* (2006.01)

(52) U.S. Cl.
CPC ..... *F01K 25/08* (2013.01); *F01L 15/08* (2013.01); *F01L 33/02* (2013.01)

(58) Field of Classification Search
USPC ..... 60/660–667, 670
See application file for complete search history.

(56) References Cited

U.S. PATENT DOCUMENTS

| | | | | |
|---|---|---|---|---|
| 3,774,397 | A * | 11/1973 | Engdahl | F01K 13/00 137/59 |
| 3,967,535 | A | 7/1976 | Rozansky | |
| 8,661,817 | B2 * | 3/2014 | Harmon, Sr. | F01B 7/20 123/41.2 |
| 2002/0139342 | A1 | 10/2002 | Trentham | |
| 2009/0205338 | A1 * | 8/2009 | Harmon, Sr. | F01K 15/02 60/677 |
| 2010/0300100 | A1 * | 12/2010 | Harmon, Sr. | F01B 7/20 60/645 |
| 2011/0271676 | A1 * | 11/2011 | Walpita | F01K 7/32 60/651 |

FOREIGN PATENT DOCUMENTS

| | | |
|---|---|---|
| RU | 2 027 028 | 1/1995 |
| RU | 2 122 642 | 11/1998 |

* cited by examiner

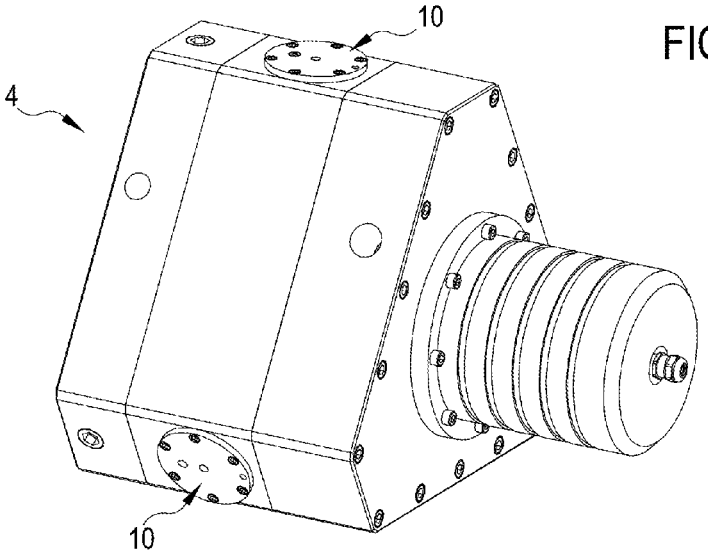
FIG.14
FIG.15
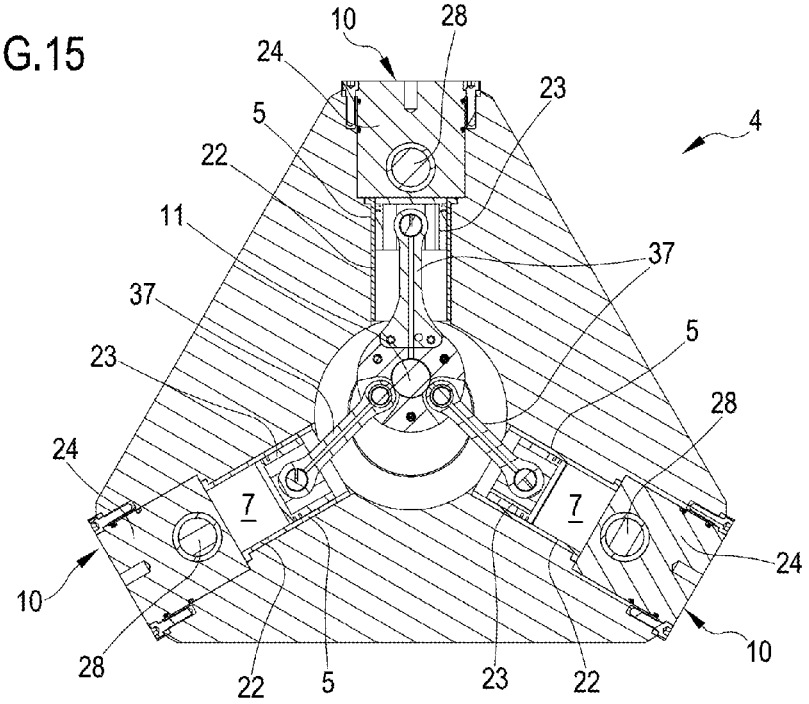

CLOSED-CYCLE PLANT

RELATED APPLICATION

This application is the U.S. national phase of International Application No. PCT/IB2014/059635 filed Mar. 11, 2014, which designated the U.S. and claims priority to Italian Patent Application MI2013A000375 filed Mar. 12, 2013, the entire contents of each of which are hereby incorporated by reference.

FIELD OF THE INVENTION

The present invention refers to a plant, for example a Rankine cycle plant, for generating electric and/or mechanical power by recovering and converting heat.

The present invention can find an application for example in biogas/biomass plants for recovering waste heat of a cogeneration process, in geothermal plants for harnessing medium/small heat sources, in industrial plants for recovering waste heat (by converting the waste heat of the industrial processes), in the domestic environment for producing electric power and harnessing the heat for sanitary use. A further use of the plant can refer to systems, both domestic and industrial systems, wherein the heat source is provided by plants absorbing solar power. Further, it is possible to provide applications of the plant in the automotive field, for example for recovering the heat from the engine (water and/or fumes).

BACKGROUND OF THE INVENTION

As it is known, heat sources are widely available, particularly at a low/medium temperature, which are now dispersed in the environment, and therefore wasted. De facto, the conversion of the heat supplied by said sources into electric power is, by the nowadays available recovering and converting means and processes, too expensive in relation with the power produced. Therefore, such sources, even though are used in a limited way for professional applications, are scarcely used by the people, and particularly in the domestic environment.

The most common heat sources, which here it is preferentially made reference to, are available both as a by-product of the human activity and in nature, such as for example the heat contained in the waste industrial products or the heat contained in the biomasses if the latter are combusted.

Several applications of the Rankine cycle for recovering thermal power and the consequent production of electric power are known. The preferred embodiment consists of using, as expansion chamber, a turbine. However, such solution has some constraints and disadvantages which are well known to the person skilled in the art, and which are:

- high cost of the turbine and of the associated control elements;
- necessity of a frequent maintenance with following duties of different type;
- maximum efficiency which is only obtained at a precisely determined flow rate of the expanding fluid and at a defined rotation speed; specifically, this is perhaps the greatest limitation of the turbine systems because if the rotation speed is affected by a slight variation with respect to the optimal value, the turbine efficiency drastically drops.

For the above mentioned reasons, it is absolutely evident that the steam turbines are not very suitable for harnessing medium/low temperature thermal sources and having an extremely variable thermal supply (as indicated in the above exemplified examples) and therefore not very suitable for small-sized plants (having a supplied electric power less than 50 KW, for example).

From documents JP 10252558, JP 10252557 and JP 10259966, some known different technical solutions using the Rankine cycle for different objects are known; however, none of the suggested solutions is particularly advantageous for generating electric power, particularly if the thermal power is supplied under an extremely variable range.

In order to overcome the above described disadvantages, it is known to use alternate or rotative volumetric expanders. Such expanders are capable of operating under relatively modest fluid flow rates without excessively reducing the power and efficiency. Further, volumetric expanders, operating at smaller thermal powers, operate at a number of revolutions (cycles) substantially smaller than the turbines rotation speeds eliminating in this way the risk of damaging the movable parts in case the liquid (drops formed by an incorrect vaporization of the working fluid) flows into the expansion chamber. Further, the above described volumetric expanders have a structural complexity smaller than the one of the turbines, with a consequent reduction of the costs.

Besides a reduced complexity, volumetric expanders are extremely more compact than the turbines, which in turn makes easier their implementation, and assembly.

An example of a volumetric expander used for converting thermal power in electric power by means of low temperature heat sources, is described in the patent application US 2012/0267898 A1 of the Applicant.

Such application describes a Rankine cycle machine comprising a cylinder and an associated piston adapted to alternately move inside said cylinder. To the piston is associated a main shaft which, in turn, is connected to a DC voltage generator formed by a rotor and a stator: the rotor is connected to and actuated by the main shaft. The cylinder is provided with an intake port and a discharge port which the working fluid flows through. For actuating the piston, the machine uses a rotative valve enabling the desired sequence among the steps of introducing, expanding, and discharging the fluid. In order to synchronize such steps to each other, the rotative valve is actuated by a plurality of motion transmission members connected to the main shaft.

Despite the described solutions (volumetric expanders) are, under conditions of low temperature heat sources, enhancing in comparison with the turbines, the above described volumetric expanders are not devoid of disadvantages. Particularly, the Applicant believes the known volumetric expanders, and also the machine described in patent application US 2012/0267898 A1 of the Applicant, are further improvable under different aspects.

OBJECT OF THE INVENTION

A first object of invention consists of providing a plant, for example a Rankine cycle, which can be adapted to different working conditions in order to effectively harness the available heat sources and supply the maximum power with excellent efficiencies.

A further main object of the invention consists of making available a plant, for example a Rankine cycle, which is suitable for operating for long periods of time without requiring any maintenance and embodying a highly integrated and compact unit.

It is a further object of the invention to make available a plant, for example a Rankine cycle, which is simple to be manufactured and easy to be installed and consequently showing extremely reduced production, maintenance and assembly costs.

Lastly, it is an object of the invention to develop a process capable of efficiently harnessing the above mentioned plant.

One or more of the above described objects which will be better understood in the following description, are substantially met by a Rankine cycle plant according to one or more of the attached claims.

SUMMARY

Aspects of the invention are herein described in the following.

In a 1st aspect, it is provided a closed cycle plant (1), particularly a Rankine cycle, for converting thermal power in electric power, comprising:

- a closed circuit (2), inside which at least one working fluid circulates according to a predetermined circulation direction,
- at least one volumetric expander (4) configured to receive at the inlet the working fluid at the gaseous state, said volumetric expander (4) comprising:
  - at least one jacket (5) having at least one inlet (8) and one outlet (9) respectively suitable for enabling to introduce and discharge the working fluid,
  - an active element (6) housed in said jacket and suitable for defining, in cooperation with said jacket (5), a variable volume expansion chamber (7),
  - a main shaft (11) associated to the active element (6) and configured to rotatively move around an axis,
  - at least one valve (10), active at the inlet and outlet of the jacket (5), and configured to selectively open and close said inlet and outlet to enable at least one condition of introducing, one condition of expanding and one condition of discharging the working fluid from said expansion chamber (7),
- at least one electric power generator (12) connected to the main shaft (11),
- the valve (10) comprising at least one regulation device (14) configured to enable to vary at least one of the following parameters:

the duration of the introduction condition;

the maximum passage cross-section of the inlet (8).

In a 2nd aspect according to aspect 1, the plant (1) comprises:

- at least one pump (13) placed on the circuit (2) and arranged to impose to the working fluid said predetermined circulation direction,
- at least one first heat exchanger (3) active on the circuit (2) and located downstream the pump (13) with reference to the working fluid circulation direction, said first heat exchanger (3) being arranged for receiving at the inlet the working fluid and being configured to receive heat from a hot source (H) and enable to heat the working fluid until it is caused the passage from the liquid state to the gaseous one, said volumetric expander (4) being connected downstream of the first heat exchanger (3), with reference to the working fluid circulation direction inside the circuit (2), and being configured to receive at the inlet the working fluid at the gaseous state, generated in the first exchanger (3).

In a 3rd aspect according to anyone of the preceding aspects, the regulation device (14) comprises at least one mask (15) movable relatively to the inlet (8) for enabling the variation of the the maximum cross-section and determining a regulation of the volumetric flow rate of the working fluid entering the expansion chamber (7) during the introduction condition.

In a 4th aspect according to the preceding aspect, the valve (10) comprises:

- a valve body (24) having at least one housing seat (25) having a substantially cylindrical shape, the valve body (24) of valve (10) further comprising at least one first and one second passages (26; 27) respectively arranged to put in fluid communication the housing seat (25) with the inlet (8) and outlet (9) of said expansion chamber (7),
- at least one distribution body (28) rotatively engaged with the inside of the housing seat (25), and comprising:
  - a first and second channels (29; 30)
  - at least one first and one second cavities (31; 32) located at one side wall of the distribution body and angularly offset from each other with reference to a rotation axis of the same distribution body (28), said first and second cavities (31; 32) being configured to put in fluid communication the first and second channels (29; 30) respectively with the first and second passages (26; 27), the distribution body (28), following the rotation inside the housing seat (25), being configured to selectively determine the introduction, expansion and discharge conditions of the volumetric expander (4).

In a 5th aspect according to the preceding aspect, the mask (15) is interposed between the first cavity (31) of the distribution body (28), and the first passage (26) of the valve (10), the mask (15) being movable relatively to the first passage (26), particularly relatively to the inlet (8), for determining a variation of said maximum cross-section.

In a 6th aspect according to aspect 4th or 5th, the mask (15) comprises a semi-cylindrical sleeve interposed between the housing seat (25) and the distribution body (28), the mask (15) being rotatively movable around the rotation axis of the distribution body (28).

In a 7th aspect according to anyone of aspects from 3rd to 6th, the mask (15), following its own angular movement, determines a predetermined number of occlusion degrees of the inlet (8), each occlusion degree being defined by the ratio of the area of the maximum cross-section of the inlet (8) without the mask (15) to the area of the maximum passage cross-section in the presence of the mask (15).

In an 8th aspect according to the preceding aspect, the occlusion degree being comprised between 1 and 3, particularly between 1 and 2, still more particularly between 1 and 1.5

In a 9th aspect according to anyone of aspects from 3rd to 8th, the regulation device (14) comprises:

- at least one first sensor (34) active on the circuit (2), and configured to generate a first detection signal referring to at least one pressure parameter of the working fluid at the gaseous state entering the volumetric expander (4),
- at least one second sensor (35) active on the circuit (2) and configured to generate a second detection signal referring to at least one pressure parameter of the working fluid at the liquid state upstream of the pump (13), and
- a control unit (33) connected to the first and second sensors (34; 35), and configured to:
  - receive from the first and second sensors (34; 35) the respective first and second detection signals;
  - process the signal received from the first and second sensors (34; 35) for determining the pressure of the working fluid respectively at the inlet of the volumetric expander (4) and upstream of the pump (13); and position the mask (15) relatively to the inlet, as a function of at least one, preferably both, of the values of said working fluid pressures.

In a 10th aspect according to anyone of aspects from 3rd to 9th, the regulation device (14) comprises at least one first pusher (44) connected, at one side, to a terminal portion of the mask (15), and at another side, to the valve body (24), said pusher (44) being configured to move relatively to the valve body (14) for displacing the mask (15), relatively to the inlet (8), into a plurality of operative positions.

In an 11th aspect according to the preceding aspect, the regulation element (14) comprises at least one second pusher (45) connected, at one side, to a terminal portion of the mask (15), and at another side, to the valve body (24), said second pusher (45) being placed on the opposite side of the first pusher with reference to the mask (15) and being configured to define a condition blocking the mask (15) following the movement of the latter in a predetermined operative position.

In a 12th aspect according to the preceding aspect, each of said first and second pushers (44; 45) comprises at least one screw arranged to push the mask (15) at a terminal end following a relative rotation of the screw with respect to the valve body (24).

In a 13th aspect according to aspect 11th or 12th, at least one of said first and second pushers (44; 45) comprises a hydraulic or pneumatic actuator connected to the control unit (33), said control unit (33) being configured to send a command signal to the actuator for determining a relative displacement of the mask (15) with respect to the inlet (8).

In a 14th aspect according to anyone of the aspects from 4th to 13th, the distribution body (28) is actuated by at least one motion transmission element connected to the main shaft (11) and configured to maintain synchronized the rotation of the distribution body (28) to the rotation of the main shaft (11).

In a 15th aspect according to anyone of the preceding aspects, the volumetric expander (4) comprises an alternate volumetric expander, wherein the expansion chamber (7) has a hollow cylindrical seat (22), while the active element (6) comprises a piston (23) countershaped to the seat (22) of the expansion chamber (7) and slidingly moveable inside the latter, or wherein the volumetric expander (4) is a rotative volumetric expander, wherein the expansion chamber (7) has a seat (22) having an epitrochoidal shape with at least two lobes, while the active element (6) comprises a piston (23) rotatively movable inside the seat.

In a 16th aspect according to anyone of aspects from 2nd to 15th, the plant comprises at least one second heat exchanger (16) active on the circuit (2) and interposed between the expander (4) and pump (13), said second heat exchanger (16) being suitable for receiving through the working fluid exiting said expander (4), said second heat exchanger (16) being configured to communicate with a cold source (C) and enable to condensate the working fluid until it is caused a complete passage from the gaseous state to the liquid state.

In a 17th aspect according to the preceding aspect, the plant comprises at least one collecting tank (17) active on the circuit (2) and interposed between the pump (13) and second exchanger (16), said collecting tank (17) being configured to contain the working fluid at the liquid state exiting said second exchanger (16).

In an 18th aspect according to the preceding aspect, the pump (13) is connected to the collecting tank (17) and being suitable for sending the working fluid at the liquid state, towards the first heat exchanger (3).

In a 19th aspect according to anyone of aspects from 2nd to 18th, the plant comprises at least one third heat exchanger (18) operatively active on the circuit (2) upstream of the first heat exchanger (3) and suitable for receiving through said working fluid, said third heat exchanger (18) being further configured to receive heat from a hot source (H) and enable to pre-heat the working fluid before introducing the latter in the first heat exchanger.

In a 20th aspect according to the preceding aspect, the third heat exchanger (18) is configured to pre-heat the working fluid until a saturated liquid condition.

In a 21st aspect according to the aspect, the first heat exchanger (3) is suitable for receiving the working fluid in a saturated liquid condition and for supplying at the outlet the working fluid in a saturated vapor condition.

In a 22nd aspect according to anyone of aspects from 19th to 21th , the first and third heat exchangers (3; 18) are positioned immediately and consecutively after each other according to a working fluid circulation direction, said first and third heat exchangers (3; 18) being configured to receive heat from the same hot source (H).

In a 23rd aspect according to anyone of aspects from 19th to 22th, the plant (1) comprises a heating circuit (19) extending between and inlet (20) and an outlet (21) and inside which at least one heating fluid from said hot source (H) is suitable for circulating, said first and third heat exchangers (3; 18) being operatively active on the heating circuit (19), and interposed between the inlet (20) and outlet (21) of said circuit (19), the heating fluid, circulating from the inlet (20) towards the outlet (21), consecutively flowing through the first and third heat exchangers (3; 18).

In a 24th aspect according to the preceding aspect, the heating fluid entering the first heat exchanger (3) has a temperature less than 150° C., particularly comprised between 25° C. and 100° C., still more particularly between 25° C. and 85° C.

In a 25th aspect according to anyone of aspects from 17th to 24th, the pump (13) is positioned downstream the volumetric expander (4) with respect to the working fluid circulation direction, particularly interposed between the collecting tank (17) and the first heat exchanger (3).

In a 26th aspect according to anyone of aspects from 2nd to 25th, the pump (13) is configured to impose a pressure jump to the working fluid, comprised between 4 bar and 30 bar, particularly between 4 and 25 bar, still more particularly between 7 bar and 25 bar.

In a 27th aspect according to anyone of the preceding aspects, the plant comprises, as a working fluid, at least one organic-type fluid.

In a 28th aspect according to the preceding aspect, the organic fluid of the working fluid is present by a percentage comprised between 90% and 99%, particularly between 95% and 99%, still more particularly about 98%.

In a 29th aspect according to aspect 27th or 28th, the organic fluid comprises at least one selected in the group of the following fluids: R134A, 245FA, R1234FY, R1234FZ.

In a 30th aspect according to anyone of the preceding aspects, the plant comprises, as a working fluid, an organic fluid comprising one or more hydrocarbons, preferably halogenated hydrocarbons, still more preferably fluorinated hydrocarbons, said working fluid having:

a melting temperature comprised between −110° C. and −95° C. at atmospheric pressure;

a boiling temperature comprised between −30° C. and −20° C. at atmospheric pressure;

a density comprised between 1.15 g/cm$^3$ and 1.25 g/cm$^3$ at a temperature of 25° C.;

a vapor pressure comprised between 600000 Pa and 700000 Pa at a temperature of 25° C.

In a 31st aspect, it is provided a process for converting thermal power in electric power, comprising the following steps:

providing a plant according to anyone of the preceding aspects;

circulating the working fluid inside the circuit (2);

heating, by the first heat exchanger (3), the working fluid flowing from the latter until such fluid is caused to evaporate and is under a saturated vapor condition;

expanding the working fluid inside the volumetric expander in order to move the active element (6) inside the jacket with a consequent rotation of the main shaft (11) and the production of electric power by said generator;

condensing the working fluid exiting the volumetric expander (4), sending the working condensated fluid to the first heat exchanger (3), the process comprising at least one step of regulating the volumetric flow rate of the working fluid entering the expansion chamber (7), performed by the regulation device (14) for varying at least one between the duration of the introduction condition and the maximum passage cross-section of the inlet (8).

In a 32nd aspect according to the preceding aspect, the step of regulating the flow rate of the working fluid comprises a relative movement of the mask (15) for varying the maximum passage cross-section of the working fluid entering the expansion chamber (7).

In a 33rd aspect according to aspect 31st or 32nd, the regulating step comprises at least the following sub-steps:

detecting, by the control unit (33), the pressure of the working fluid at the gaseous state upstream of the expander (4);

detecting, by the control unit (33), the pressure of the working fluid at the liquid state upstream of the pump (13);

comparing the pressure value upstream of the expander (4) and/or upstream of the pump (13) with a respective reference value;

positioning the mask (15) relatively to the inlet (8) as a function of at least one, preferably both, of the values of said working fluid pressures.

In a 34th aspect according to anyone of aspects from 31st to 33rd, the process comprises at least one step of condensing the working fluid exiting the expander (4) by the second heat exchanger (16), the process further comprises a step of collecting the working fluid condensated inside the collecting tank (17), the step of sending the working fluid to the first exchanger, comprises a sub-step of withdrawing the working fluid at the liquid state present inside the collecting tank (17) by the pump (13).

In a 35th aspect according to anyone of aspects from 31st to 34th, the step of heating the working fluid, enables, by the first heat exchanger (3), to bring the latter to a temperature less than 150° C., particularly less than 90° C., still more particularly comprised between 25° C. and 85° C., In a 36th aspect according to anyone of aspects from 31st to 35th, the step of heating the working fluid, comprises a sub-step of preheating the working fluid by the third heat exchanger (18) before introducing the latter in the first heat exchanger (3), the preheating step bringing the working fluid to a temperature comprised between 25° C. and 130° C., particularly between 15° C. and 85° C., the heating step enabling to maintain the latter in a saturated liquid condition.

In a 37th aspect according to anyone of aspects from 32nd to 37th, the fluid sending step enables to impose, by the pump (13), a pressure jump to the working fluid comprised between 4 bar and 30 bar, particularly between 4 bar and 25 bar, still more particularly between 7 bar and 25 bar.

DESCRIPTION OF THE DRAWINGS

Some embodiments and some aspects of the invention will be described in the following with reference to the attached drawings, supplied in an exemplifying and therefore non limiting way, wherein:

FIG. 14 is a perspective view of a further embodiment of a volumetric expander according to the present invention;

FIG. 15 is a cross-section view of the volumetric expander in FIG. 14;

DETAILED DESCRIPTION

General Embodiment of a Closed Cycle Plant for Producing Electric Power

With 1 has been generally indicated a closed cycle plant, particularly a Rankine cycle, for converting thermal power in electric power. The plant 1 finds, for example, application in biogas/biomass plants for recovering waste heat of a cogeneration process, in geothermal plants for harnessing medium/small heat sources, in industrial plants for recovering heat waste (conversion of heat waste from industrial processes), in the domestic environment for producing electric power and harnessing the heat for sanitary use. A further use of the plant 1 can regard both domestic and industrial systems, wherein the heat source is provided by systems absorbing solar power. Further applications of the plant in the automotive field, for example for recovering heat from the engine (water and/or fumes), are provided.

As it is visible in FIG. 1, the plant 1 comprises a closed circuit 2 inside which a working fluid circulates; the characteristics of the working fluid will be better described in the following.

Figure 1:
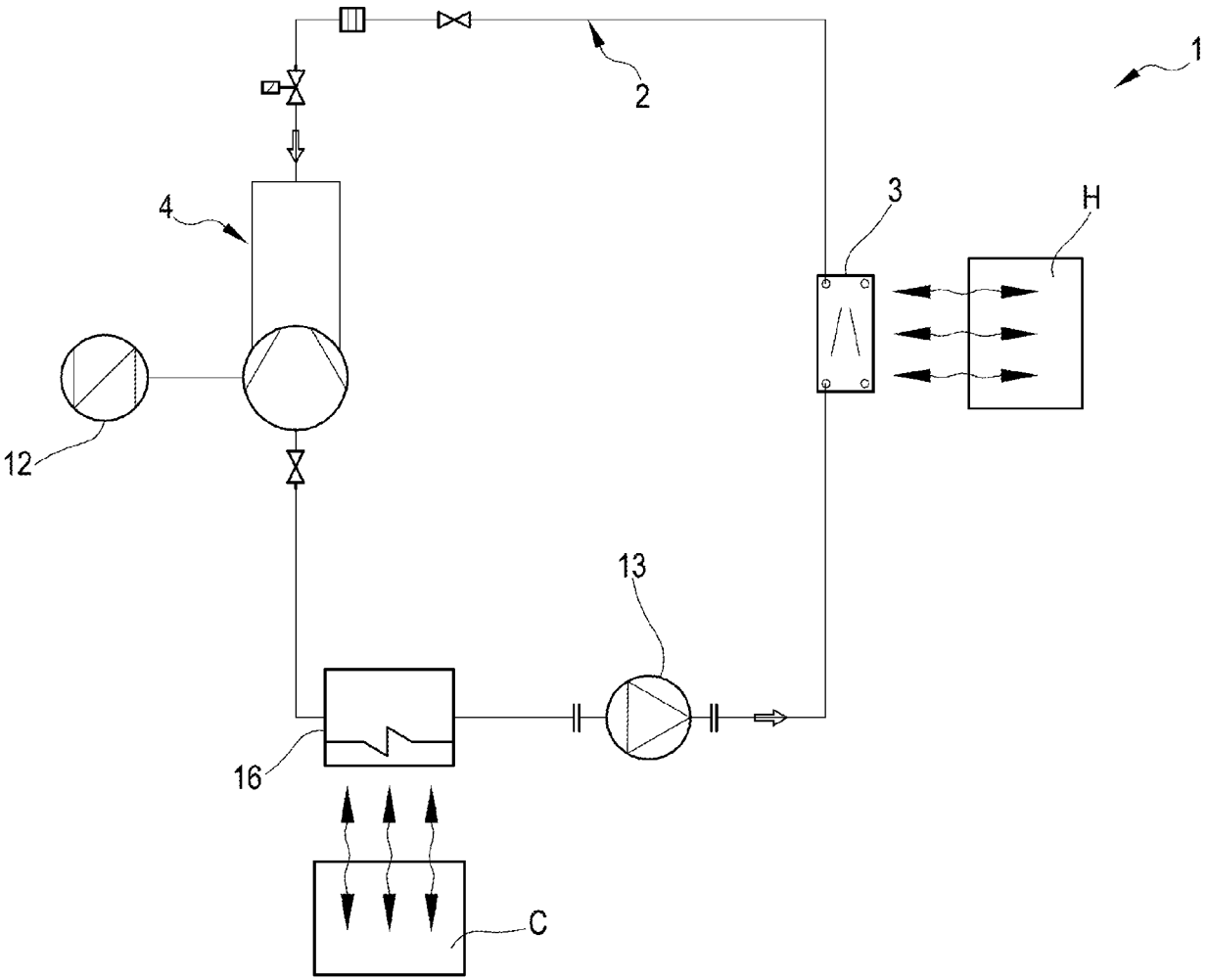
FIG. 1 is an in-principle scheme of the closed cycle plant according to a first embodiment according to the present invention.
Figure 2:
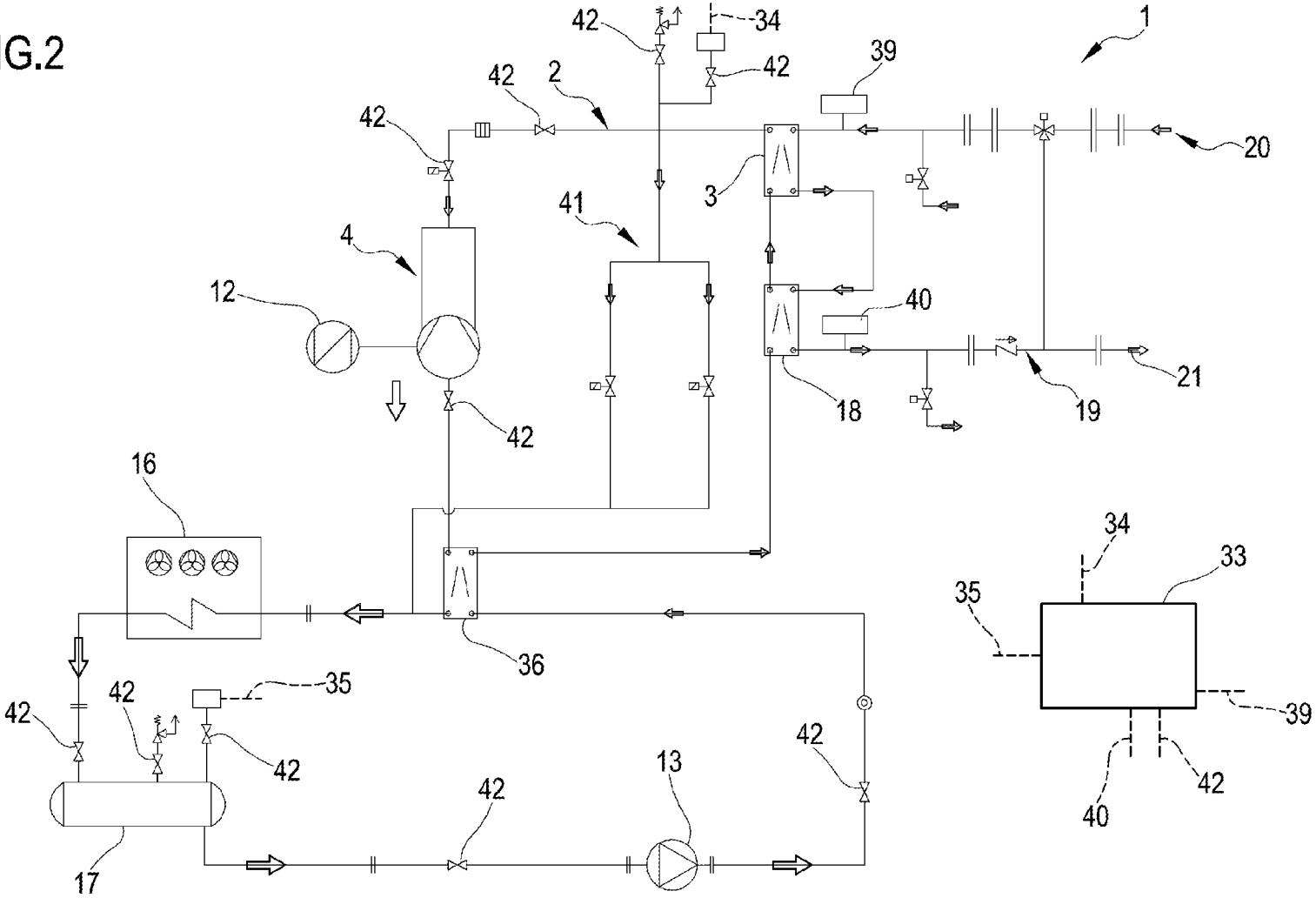
FIG. 2 is an in-principle scheme of the closed cycle plant according to a second embodiment in conformity with the present invention.
Figure 3:
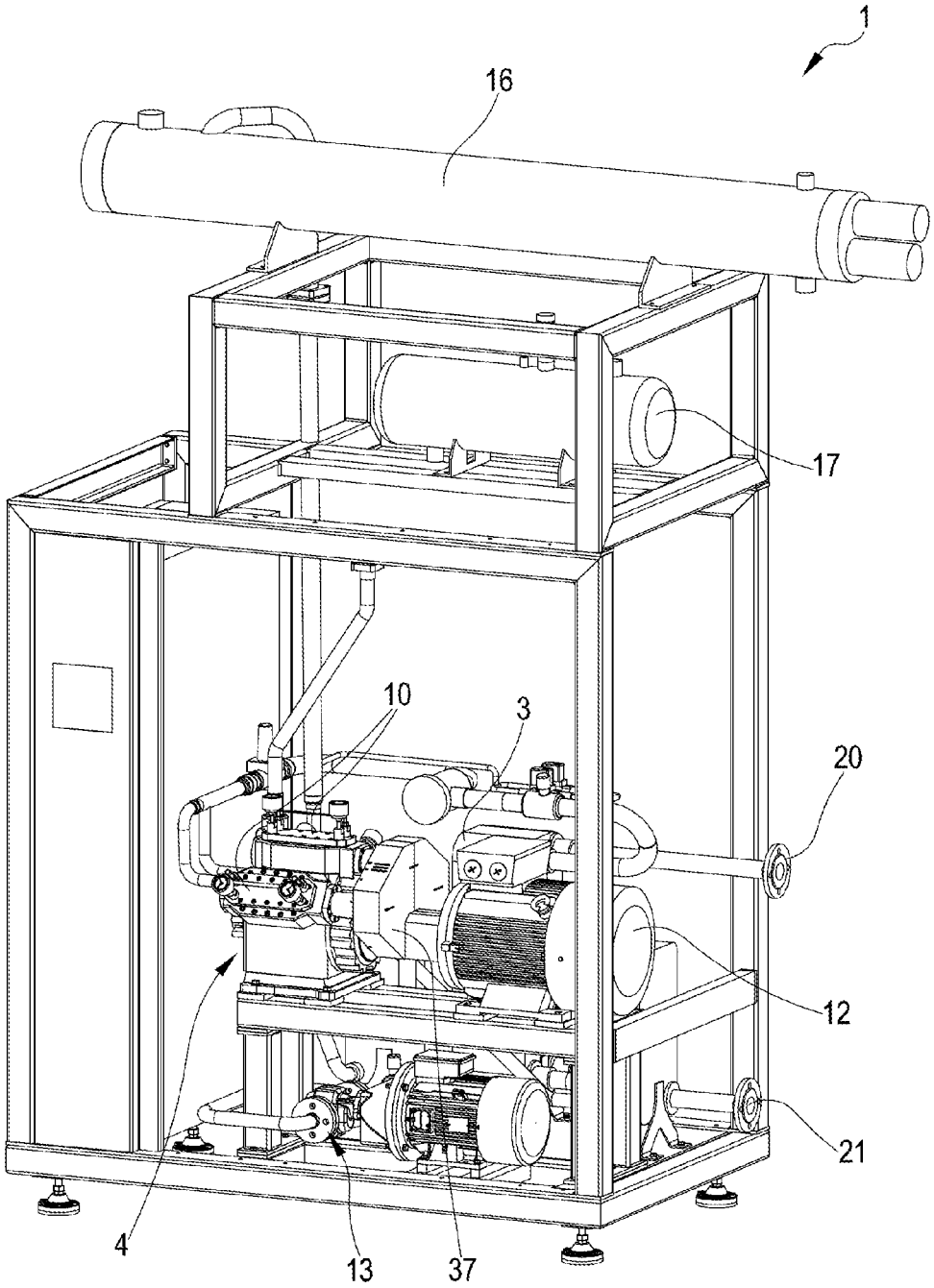
FIG. 3 is a perspective view of the closed cycle plant according to a preferred embodiment of the present invention.
Figure 5:
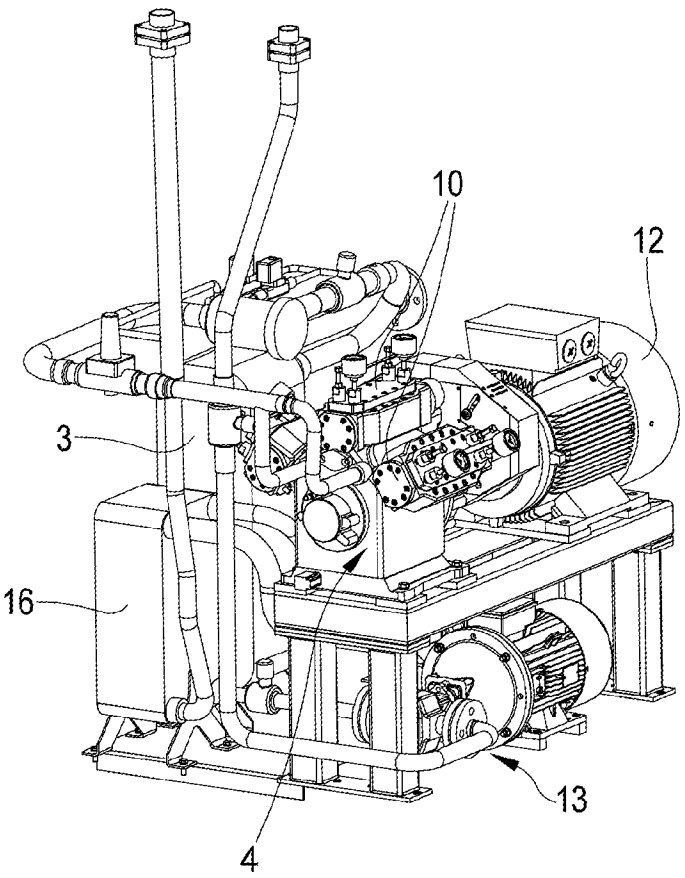
FIGS. 4, 5, and 6 are detailed perspective views of some details of the plant in FIG. 2.
Figure 4:
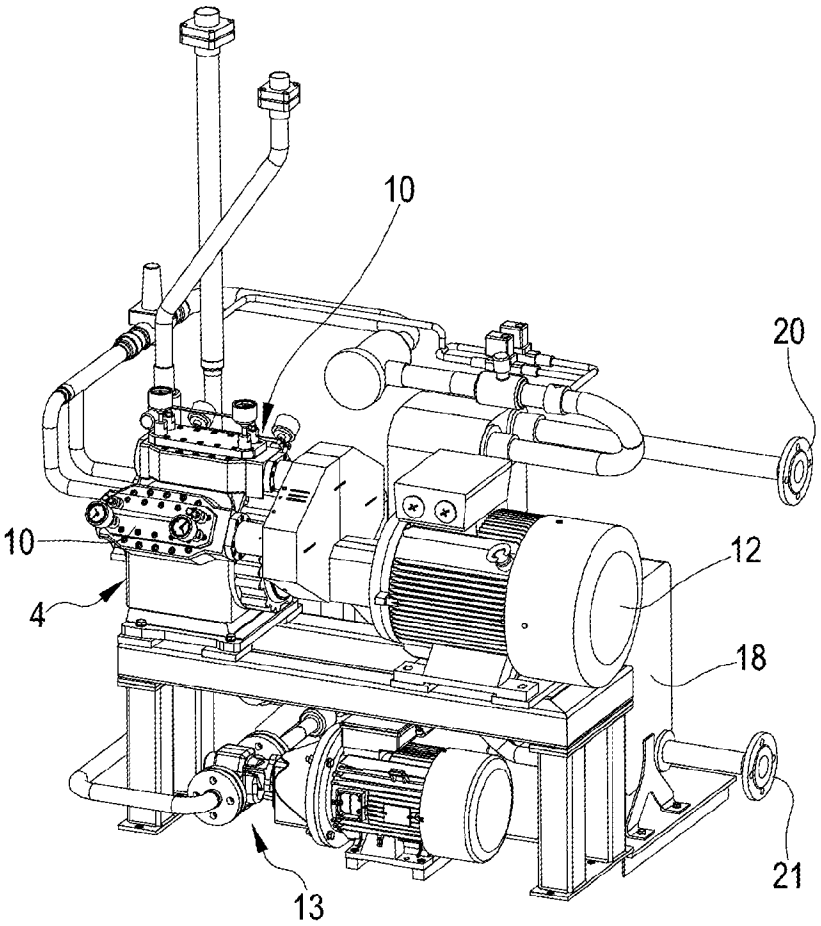

As it is visible for example in the schematic views of FIGS. 1 and 2, the plant 1 comprises at least one pump 13 placed on the circuit 2 and suitable for applying a predetermined circulation direction to the working fluid. In a preferred but non limiting embodiment of the plant 1, the pump 13 comprises a geared pump. The working fluid entering the pump 13 is at the liquid state at a predetermined pressure corresponding to a minimum pressure of the circuit. The pump 13 is configured to apply to the working fluid a predetermined pressure jump and take it to a maximum pressure in the circuit 2. The pressure jump imposed by pump 13 depends on the size of the latter and is greater than or equal to 5 bar, particularly is comprised between 5 bar and 25 bar, still more particularly between 5 bar and 20 bar.

Due to the pressure jump imposed by the pump 13, the working fluid circulates in circuit 2 and particularly exiting from the latter the fluid arrives in a first heat exchanger or vaporizer 3 active on circuit 2. De facto, the working fluid at the liquid state supplied by pump 13, is introduced inside the vaporizer 3 which is configured to heat said fluid until it is caused the passage from the liquid state to the gaseous state. More particularly, the vaporizer 3 is arranged to receive the passing working fluid and further receive heat from a hot source H (FIGS. 1 and 2) suitable for enabling to heat said fluid to the state change: the working fluid, exiting the vaporizer 3, is in a saturated vapor condition.

From a structural point of view, the vaporizer 3 can, for example, comprise one heat exchanger suitable for harnessing, as hot source H, a further working fluid supplied by a different industrial plant. Alternatively, the vaporizer 3 can comprise a boiler suitable for enabling the state change of the working fluid by means of a hot source H obtained by combustion.

Following again along the circulation direction of the working fluid, it is possible to observe that the working fluid at the gaseous state exiting the first heat exchanger 3, enters a volumetric expander 4 configured to convert the thermal power of the working fluid in mechanical power (FIGS. 1 and 2).

Figure 12:
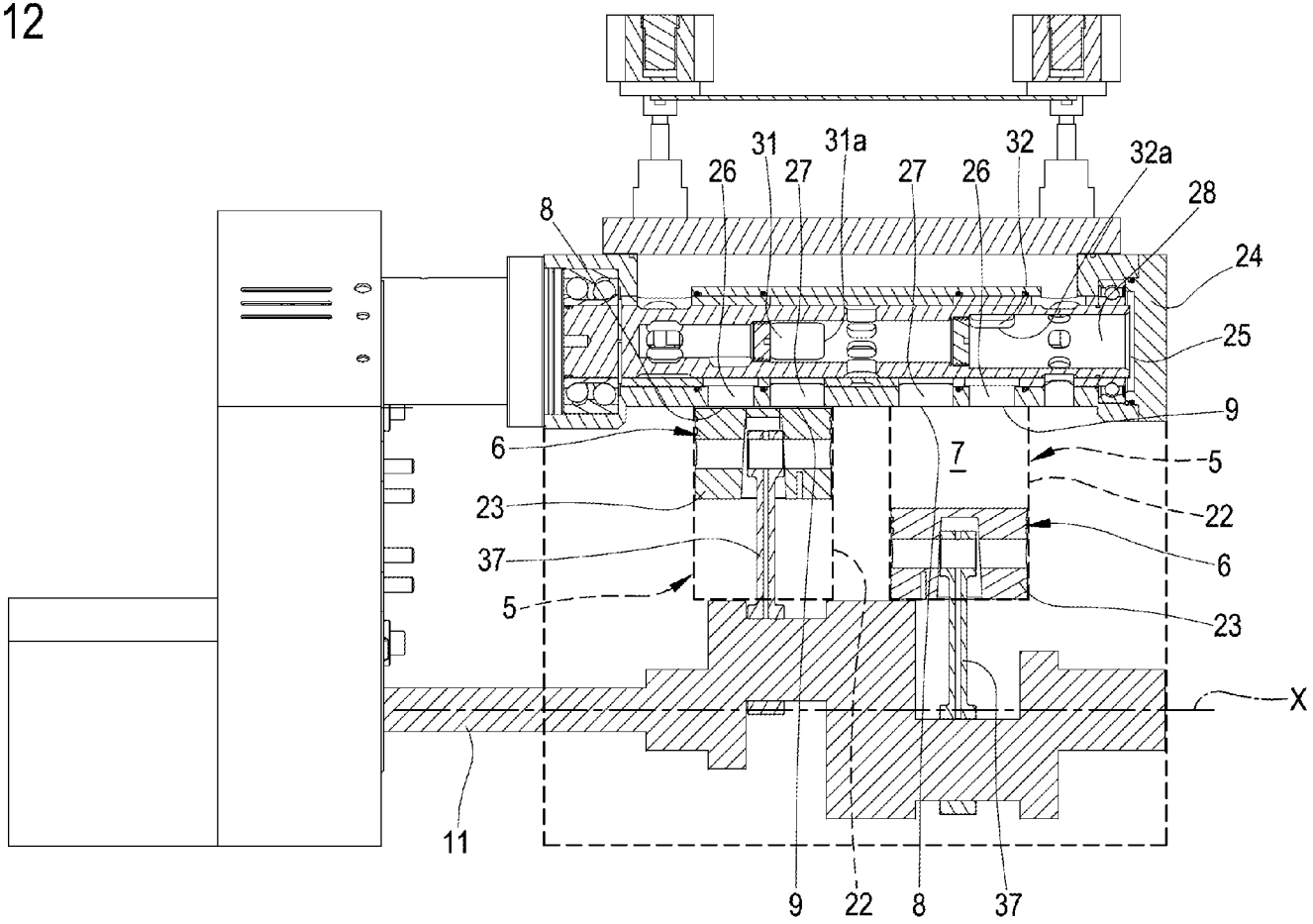
FIG. 12 is a longitudinal cross-section view of the preferred form of the expander and valve in FIG. 7.
Figure 13:
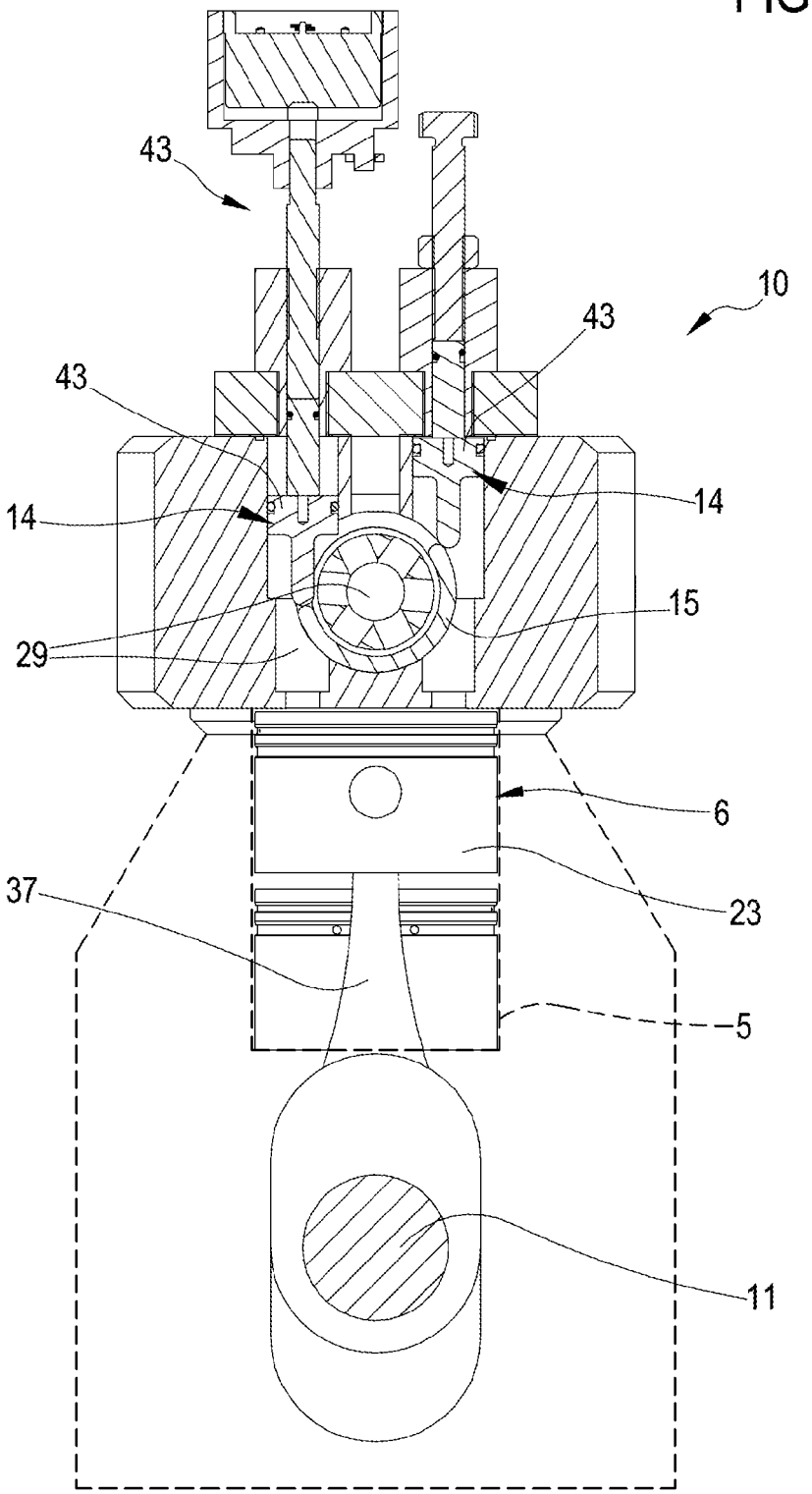
FIG. 13 is a cross-section view of the preferred form of the expander and valve in FIG. 7.

The volumetric expander 4 comprises at least one jacket 5 housing an active element 6 suitable for defining, in cooperation with said jacket 5, a variable volume expansion chamber 7 (see FIG. 12, for example).

Further, the volumetric expander 4 comprises a transmission element 37 connected, at one side, to the active element 6, and at the another side, is associated to a main shaft 11 configured to rotatively move around an axis X (see FIG. 12). The jacket 5 has an inlet 8 and an outlet 9 respectively suitable for enabling to introduce and discharge the working fluid from the expansion chamber 7. Particularly, the volumetric expander 4 comprises at least one valve 10 configured to selectively enable to introduce and discharge the working fluid from the expansion chamber 7 through the inlet 8 and outlet 9 and generate the movement of the active element 6: in this way it is possible to rotate the main shaft 11 around the axis. The volumetric expander 4 will be particularly described in the following.

As it is visible for example in FIGS. 1 and 2, further the plant comprises at least one electric power generator 12 connected to the main shaft 11 which is suitable for transforming the rotation of the latter in electric power. Particularly, the generator 12 can comprise at least one rotor connected to the main shaft 11 which is rotatively movable with respect to a stator. The relative movement between the rotor and stator enables to generate a predetermined amount of electric power. Still following again along the working fluid circulation direction, it is possible to observe that the plant 1 further comprises at least one second heat exchanger or condenser 16 active on the circuit 2 (FIGS. 1 and 2). The condenser 16, as visible for example in FIG. 1, is interposed between the expander 4 and pump 13; the second heat exchanger 16 is suitable for receiving the passing working fluid exiting the expander 4 and enabling the change from the gaseous state to the liquid one. More particularly, the condenser 16 is configured to receive the passing working fluid and further communicate with a cold source C which is suitable for subtracting heat from the fluid flowing through said second heat exchanger 16. The working fluid exiting the condenser 16 reenters the pump 13: the so defined circuit is a closed cycle, particularly a closed Rankine cycle.

Preferred Embodiment of a Closed Cycle Plant for Producing Electric Power

A non limiting preferred embodiment of the plant 1 is illustrated in FIG. 2. The latter, in addition to the general embodiment of the plant 1, comprises an economizer 36 placed downstream of both the pump 13 and volumetric expander 4. More particularly, the economizer 36 comprises a heat exchanger suitable for receiving the working fluid exiting the volumetric expander 4 and the working fluid exiting pump 13. Actually, the economizer 36 enables to preheat the working fluid exiting the pump due to the recovered heat of the working fluid exiting the volumetric expander 4. As it is still visible from FIG. 2, the plant 1 further comprises a third heat exchanger or pre-heater 18 active on the circuit 2, upstream of the first heat exchanger 3 and particularly interposed between the economizer 3 and vaporizer 3. The third heat exchanger 18 is configured to receive the passing working fluid exiting the pump 13 and preheated by the economizer 36. Moreover, the third heat exchanger 18 is configured to receive heat from a hot source H, and enable to further preheat the working fluid before introducing the latter in the first heat exchanger 3.

In the embodiments illustrated in the attached figures, the third heat exchanger 18 consists, in a non limiting way, in a detail distinct (independent) from the economizer 36 and vaporizer 3. Alternatively, the pre-heater 18 could be integrated with the vaporizer 3 to substantially form an "all-in-one" exchanger (this condition is not illustrated in the attached figures); in this last described condition, the plant 1 can comprise only two exchangers (an "all-in-one" exchanger and an economizer 36) or just one exchanger (only the "all-in-one" exchanger) if the heat recovery by the economizer 36 is discarded.

Preferably, the plant 1 comprises at least one heating circuit 19 (FIG. 2) fluidically communicating with both the first heat exchanger 3 and third heat exchanger 18; the circuit 19 is suitable for enabling the circulation of at least one heating fluid from the hot source H. The heating circuit 19 comprises, in a non limiting way, a hydraulic circuit extending between an inlet 20 and outlet 21. The hot source H can, for example, comprise a source of heated water suitable for circulating from the inlet 20 until it exits the circuit through the outlet 21. Advantageously, the heating fluid circulation direction of the hot source H (heated water, in the preferred form) is in the opposite direction with respect to the circulation direction of the working fluid inside the circuit 2. De facto, in the embodiment of FIG. 2, the vaporizer 3 is a liquid (heat water) and gas (working fluid at the gaseous state) heat exchanger. The third heart exchanger 18, also active on the heating circuit 19, harnesses the heat from the same hot source H used for the vaporizer 3 of the working fluid. Since the working fluid in the circuit 2 has a direction opposite with respect to the heating fluid (heated water) of circuit 19, the latter fluid has a temperature which decreases during the passage from the vaporizer 3 to pre-heater 18. Advantageously, in the "all-in-one" condition, the integration of the pre-heater 18 with the vaporizer 3 enables to form only one heat exchanger which enables to substantially reduce the load losses on the side of the heating circuit 19.

The heating fluid entering the circuit 19, has a temperature less than 150° C., particularly comprised between 25° C. and 130° C. The temperature of the heating fluid is suitable for enabling to vaporize the working fluid. At the outlet of the vaporizer 3, the heating fluid has a temperature less than the temperature of the same entering from said vaporizer: such temperature decrease is caused by the heat released by the heating fluid to the working fluid. Specifically, the heating fluid entering the third exchanger 18, has a temperature less than 100° C., particularly comprised between 20° C. and 90° C.

The first and third heat exchangers 3, 18 are structurally sized so that the working fluid passing from the latter, is maintained in a saturated liquid condition inside the third exchanger 18, while the state change of the working fluid from the liquid to the gaseous state takes place only in the first exchanger 3.

As it is visible in FIG. 2, advantageously the plant comprises at least one first temperature sensor 39 active on the heating circuit 19 and interposed between the inlet 20 and vaporizer 3. The first temperature sensor 39 is configured to determine a control signal regarding the temperature of the hot fluid entering the vaporizer 3. Moreover, the plant 1 can comprise a second temperature sensor 40 active on the heating circuit 19 and interposed between the outlet 21 and pre-heater 18. The second temperature sensor 40 is configured to determine a control signal regarding the temperature of the hot fluid exiting the pre-heater 18.

As it is visible in FIG. 2, advantageously the plant comprises a first pressure sensor 34 active on the circuit 2 and interposed between the vaporizer 3 and volumetric expander 4. The first pressure sensor 34 is configured to generate a control signal regarding the pressure of working fluid entering the volumetric expander 4, in other words at the maximum pressure of the circuit 2. As it is visible again in FIG. 2, further, the plant 1 comprises a second pressure sensor placed upstream of the pump 13 and configured to generate a control signal regarding the pressure of the working fluid entering the latter, in other words regarding the minimum pressure of the circuit.

Advantageously, the plant 1 comprises a control unit which is connected to the first and second temperature sensors 39, 40 and to the first and second pressure sensors 34, 35. The control unit 33 is configured to receive the control signals of sensors 39 and 34 and determine the temperature of the hot source H at the inlet and at the outlet respectively from the vaporizer 3 and pre-heater 18: in this way, the control unit 33 is capable of monitoring the hot source H and consequently the heat supplied to the exchangers. As said before, further, the control unit 33 is connected to the first and second pressure sensors 34 and 34; said unit 33 is configured to receive the control signals of sensors 34 and 35 for determining the pressure of the working fluid entering and exiting respectively the volumetric expander 4 and pump 13, in other words the maximum and minimum pressure of the circuit 2. In this way, the control unit 33 can monitor the values of the pressure of the working fluid in circuit 2. Preferably, the control unit 33 is further configured to compare the pressure at the inlet of the expander 4 with a predetermined reference value, for example referred to a minimum required pressure value, and determine an intervention or alarm condition in case the measured pressure value is less than the reference value. De facto, the monitoring executed by the control unit is for setting/controlling the difference between the saturation temperature and the working temperature of the fluid, in other words for determining if the working fluid is in a saturated vapor condition or is still in a phase change (the change from the liquid phase to the gaseous one).

Advantageously, the plant 1 can be provided with a bypass circuit 41 fluidically communicating with the circuit 2 and suitable for enabling to bypass the volumetric expander 4. More particularly, the bypass circuit 41 is connected upstream and downstream of the expander 4 and thanks to the presence of interception elements 42 (solenoid valves) both in the circuit 2 and the bypass circuit 41 it is possible to manage the path of the working fluid and possibly bypass the volumetric expander 4.

Advantageously, the control unit 33 is connected to the interceptionelements 42: due to the pressures monitoring, the control unit 33 is configured to determine a possible intervention condition (as previously described for example a condition wherein the maximum pressure of the working fluid is less than a predetermined limit) and command to bypass the expander until the circulation pressure of the working fluid does not exceed a pre-established level: in this way it is possible to prevent the working fluid from being introduced in the expander 4 at a too low pressure.

A further additional component of the plant in FIG. 2 is represented by the collecting tank 17; the latter is active on the circuit 2 between the condenser 16 and pump 13. The collecting tank 17 has the function of collecting and containing the working fluid at the liquid state, exiting the condenser 16 in order to secure the height of liquid suction to the pump 13. Particularly, the tank 17 prevents to pump a working fluid filled with air bubbles which can cause a malfunction inside the plant 1.

Volumetric Expander (4)

The volumetric expander 4, according to the present invention, comprises at least one jacket or cylinder 5 housing an active element 6 suitable for defining, in cooperation with the jacket 5, a variable volume expansion chamber 7. The attached figures represent, in a non limiting way, a volumetric expander 4 having a jacket 5 comprising a cylindrical shaped seat 22 inside which a plunger-type piston 23 having also a shape at least partially countershaped (cylindrical) to the seat is slidingly moveable: in this way, the expander 4 defines an alternate-type volumetric expander 4.

Figure 6:
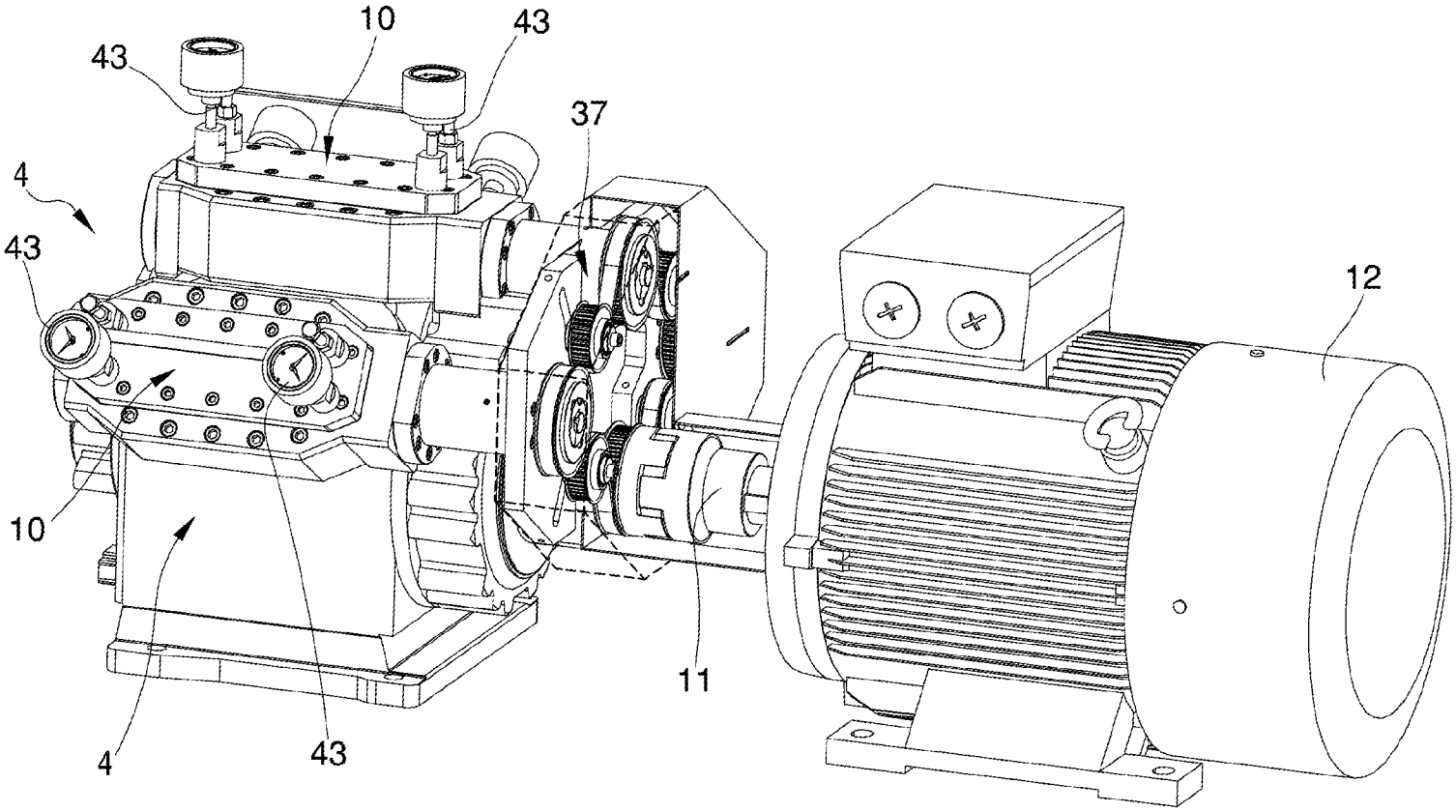

In a first embodiment shown for example in FIG. 6, the expander 4 preferably comprises six cylinders arranged by pairs (cylinders arranged two by two) angularly offset from each other with reference to the rotation axis X of the main shaft 11. In a preferred embodiment of the invention, the expander 4 comprises nine cylinders (this condition is not shown in the attached figures); however it is not excluded the possibility of using a different number of cylinders, for example twelve cylinders or just only two cylinders.

In the just described arrangement, each active element 6 is connected to the same main shaft 11 which is formed by "goose-neck" portions (see FIG. 12) carrying, in a known way, two or more active elements (pistons) 6.

Figure 16:
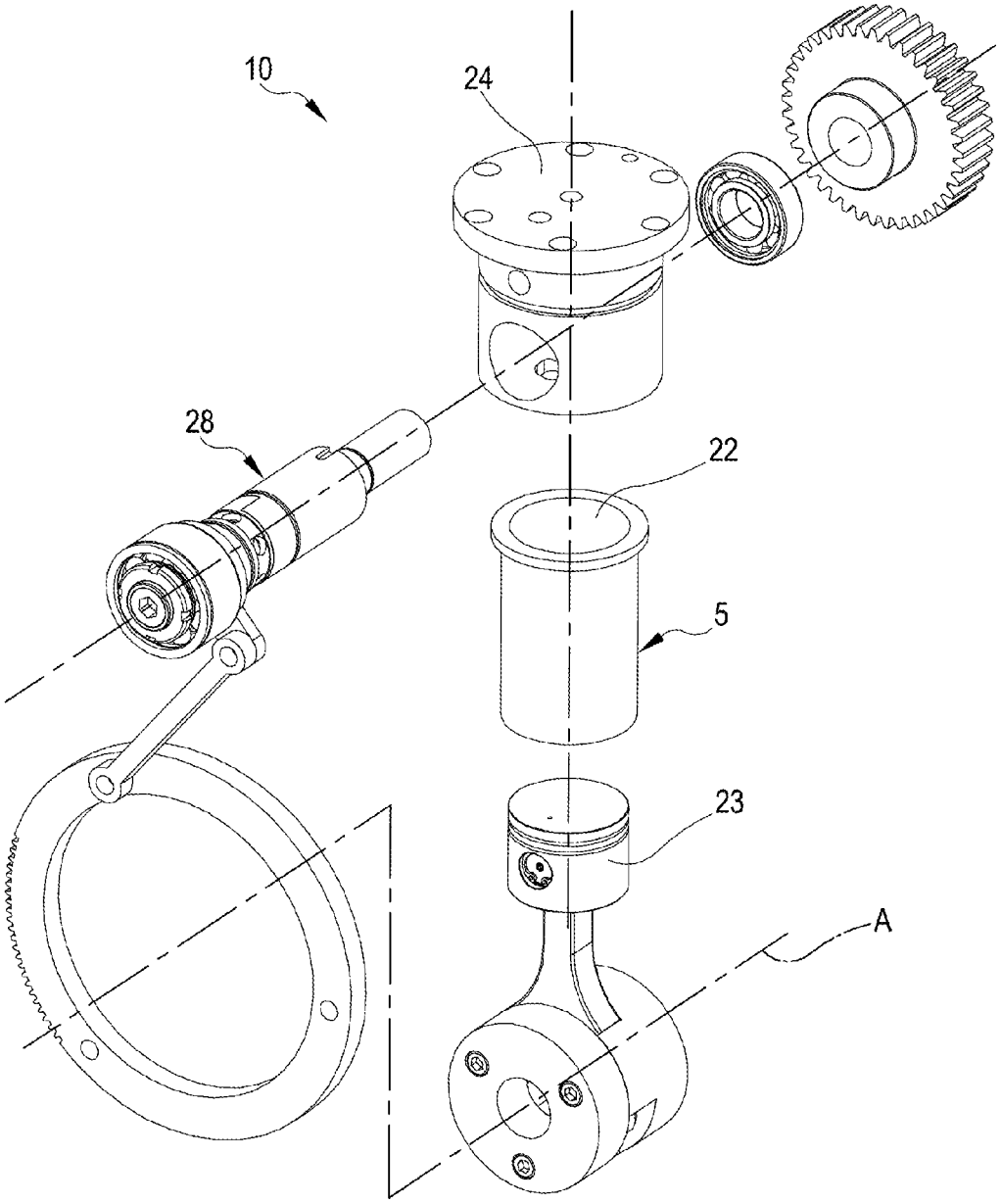
FIG. 16 is a detail of features of the volumetric expander in FIGS. 14 and 15.

A further embodiment of the plunger expander 4 is shown in FIGS. 14-16, wherein the expander substantially defines a radial or star cylinders expander wherein the cylinders are arranged according to radial lines, around the main shaft 11. In the case shown in FIGS. 14-16, the radial expander preferably consists of only one "star" formed by three radial cylinders; however, the expander can consist of several "stars", that is by several independent series of cylinders (this condition is not illustrated in the attached figures).

Besides the use of an alternate expander, it is possible to implement a rotative-type expander 4, wherein the expansion chamber 7 has a seat having an epitrochoidal shape with two or more lobes, inside which a rotative piston 23 is rotatively movable.

In a further alternative, the plant 1 can use expanders having a "free pistons" arrangement or can use an expander configured to obtain an exclusively rectilinear alternate motion applied to linear-type generators.

As previously said with reference to the motion transmission from the active element to the main shaft, the expander 4 comprises, independently from the type of the employed expander 4, a transmission element 37 (for example a rod in case of an alternate volumetric expander as shown in FIG. 12) connected, at one side, to the active element 6 while at the opposite part, is constrained, particularly is hinged, to the main shaft 11 which is suitable for rotating around the axis X (see again FIG. 12): such connection enables the active element 6 to determine the rotation of the main shaft 11 around the axis X and therefore to convert the thermal power of the working fluid in mechanical power.

As previously described, the jacket 5 has at least one inlet 8 and one outlet 9 respectively suitable for enabling to introduce and discharge the working fluid, arriving from vaporizer 3, in the expansion chamber 7. The volumetric expander 4 is fluidically communicating with the circuit 2 by said inlet 8 and said outlet 9 which are respectively suitable for enabling to introduce the working fluid into the expansion chamber 7 and then to discharge it.

For determining the movement of each active element 6, the circulation of the working fluid passing from the volumetric expander, particularly from the expansion chamber 7 must be regulated. For this reason, the volumetric expander 4 comprises a valve 10 located, in a non limiting way, outside the expansion chamber 7 (substantially defining the head of the jacket 5) and configured to enable to selectively introduce and discharge the working fluid from the expansion chamber 7. More particularly, the valve 10 is configured to define inside the expansion chamber 7 predetermined operative conditions, such as:

- an introduction condition which enables the fluid to flow from the inlet 8 while preventing the fluid from flowing from outlet 9;
- an expansion condition which prevents the fluid from flowing both from the inlet 8 and outlet 9 of the expansion chamber 7;
- a discharge condition which prevents the fluid from flowing from the inlet 8 while enabling the fluid to flow from outlet 9.

Based on what has been said, it is possible to observe that the working fluid exiting the first heat exchanger or vaporizer 3 has not a direct fluid communication with the working fluid exiting the expander 4 because the flow is interrupted due to the closure of the inlet and outlet by the definition of the expansion condition. The sequence of the above described conditions defines a working cycle of the fluid inside the expansion chamber. By alternating the introduction, expansion and discharge conditions, the valve 10 enables to move the active element 6 inside the jacket (an alternate sliding in case of a piston expander, or a rotation in case of a rotative expander). From this point of view, the expander 4 substantially defines a two-stroke engine executing a complete cycle of introduction and discharge in just only one revolution of the main shaft.

The valve 10, in order to ensure the rotation of the main shaft 11, must synchronize the expansion conditions inside the two jackets 5 so that the latter do not simultaneously occur (timing of the active elements 6).

Figure 7:
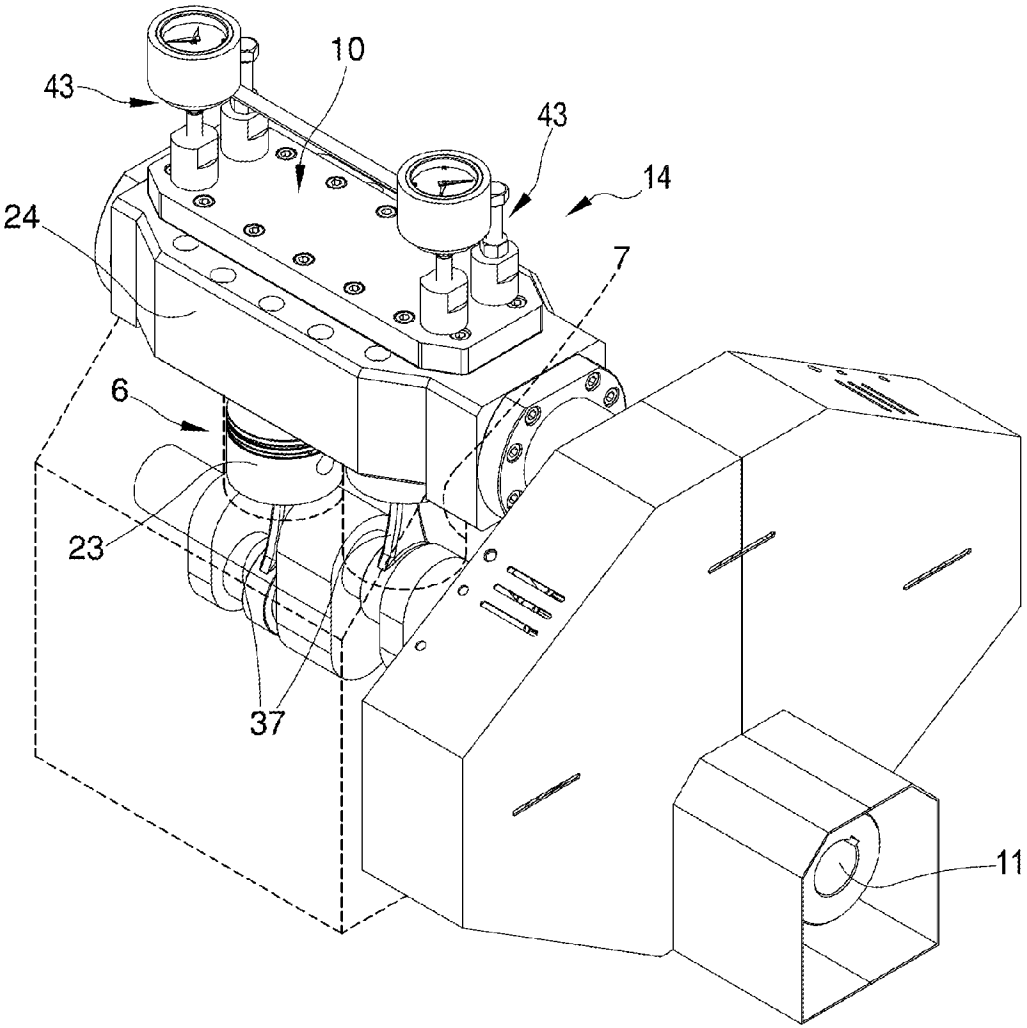
FIG. 7 is a non-limiting schematic view of a preferred form of a volumetric expander associated to a preferred form of a valve.
Figure 7A:
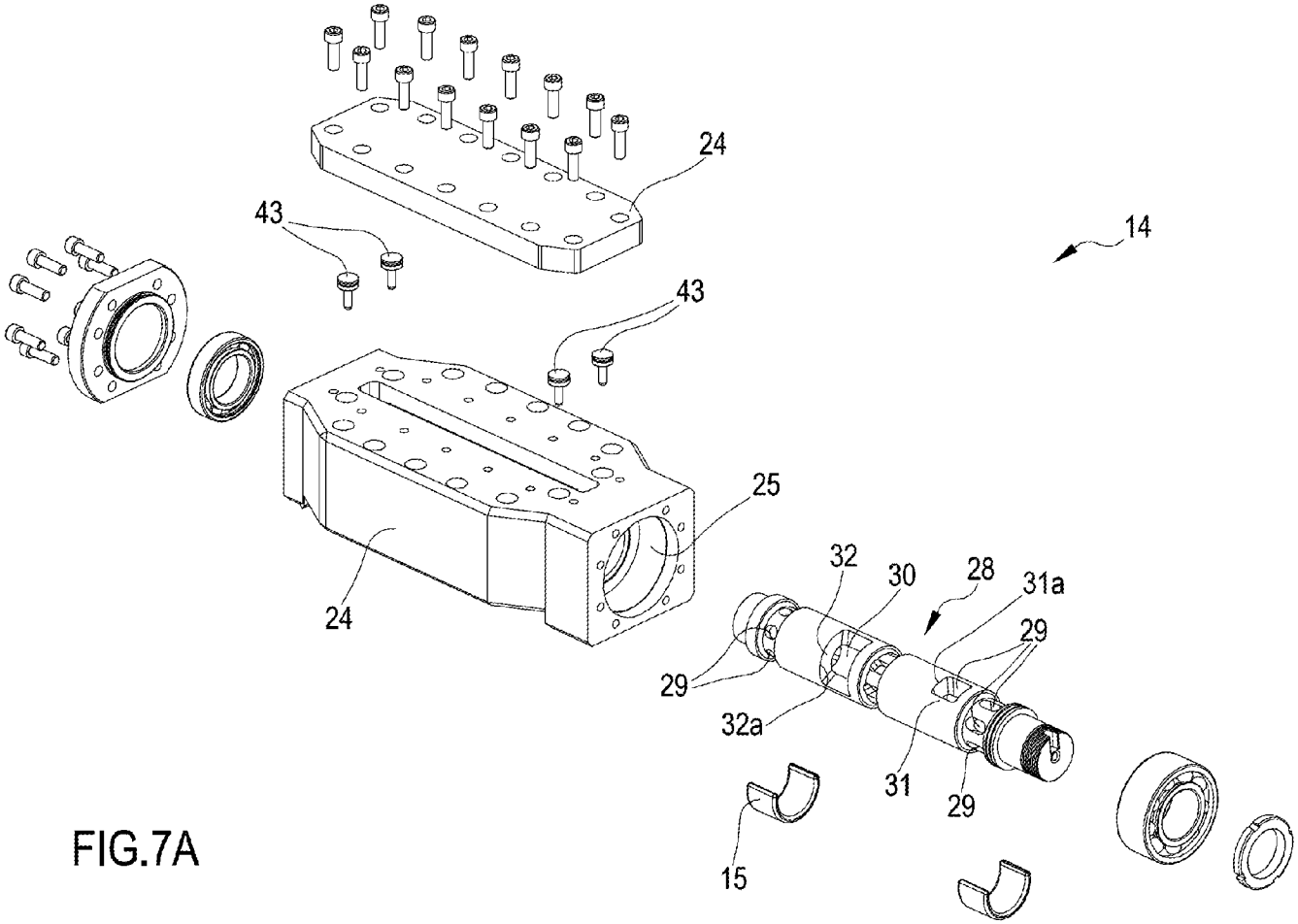
FIG. 7A is an exploded view of a regulation device according to the present invention.
Figure 8:
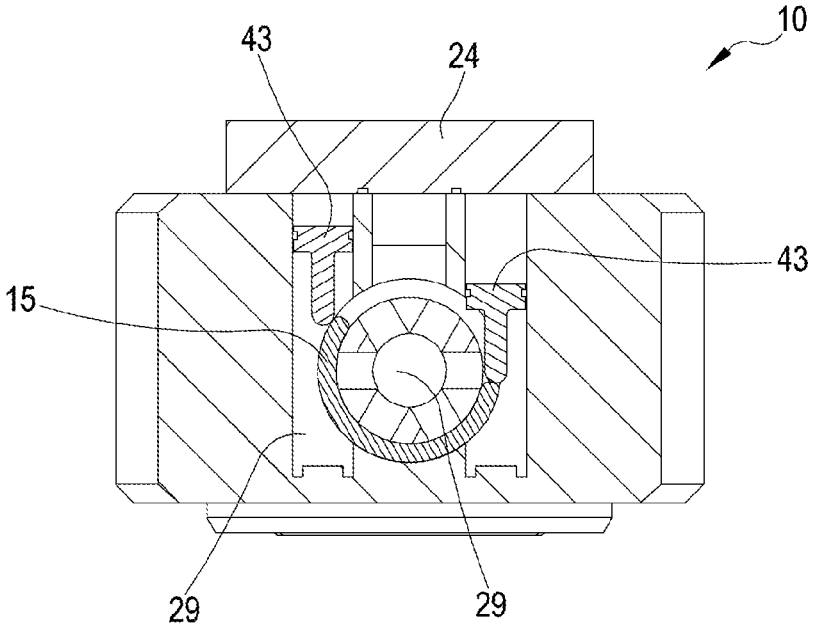
FIGS. 8 and 9 are cross-section views of the regulation device placed respectively in different operative conditions.
Figure 9:
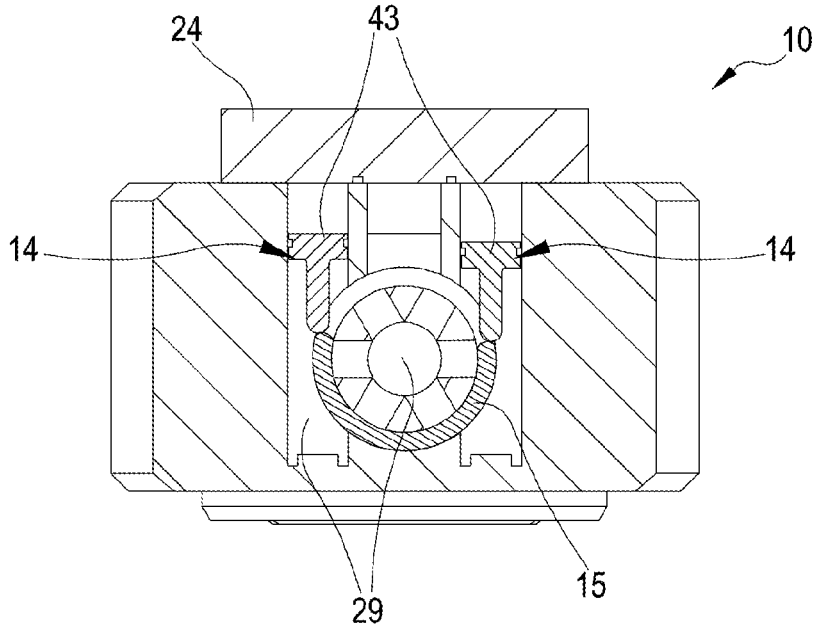
Figure 10:
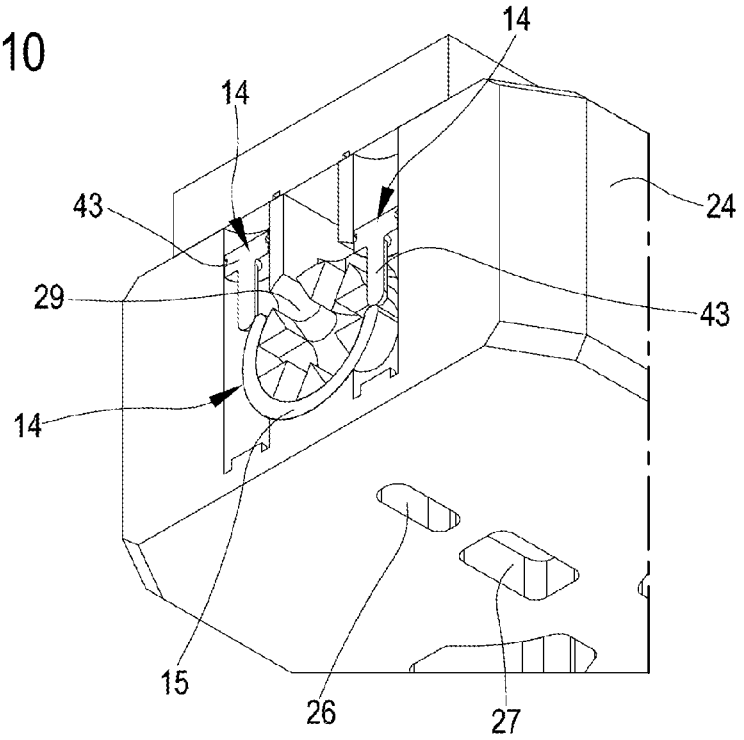
FIGS. 10 and 11 are bottom partially perspective views of a cut portion of the regulation device respectively placed in two different operative conditions.
Figure 11:
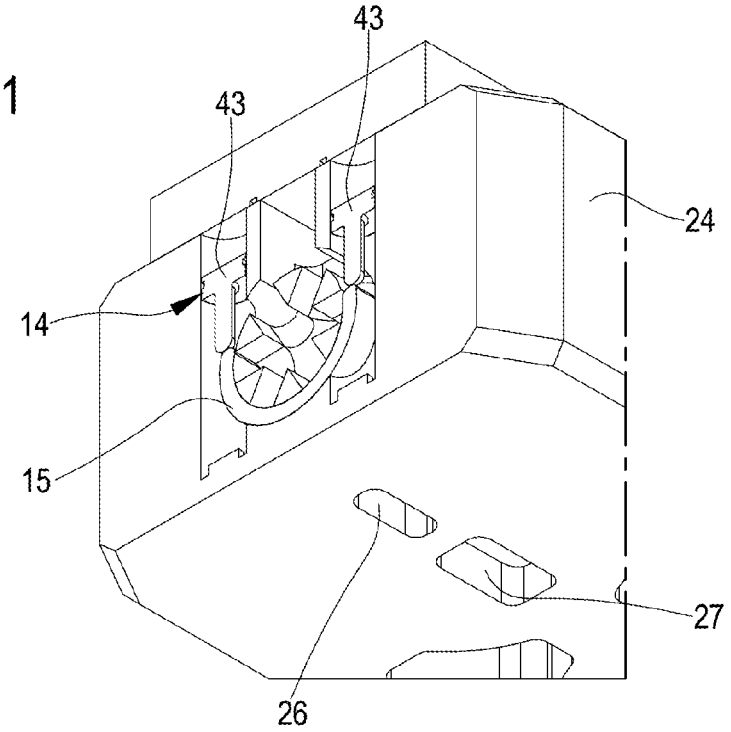

More particularly, the valve 10 comprises a valve body exhibiting a housing seat 25 having, in a non limiting way, a substantially cylindrical shape. The body 24 of the valve 10 further comprises at least one first and one second passages 26, 27 (FIG. 12) respectively suitable to put in fluid communication the housing seat 25 with the inlet 8 and outlet 9 of the expansion chamber 7. The valve 10 further comprises at least one distribution body 28 (FIG. 12) configured to movably constrain inside the housing seat 25. De facto, the distribution body 28 exhibits, in a non limiting way, a shape at least partially countershaped to the housing seat 25 (having a substantially cylindrical shape) and is rotatively engaged inside the latter in order to substantially define a rotative valve. The distribution body 28 comprises a first and second channels 29, 30 (FIG. 7A) respectively defining an intake/introduction passage and a discharge passage. Such body 28 comprises, at a side wall, at least one first and one second cavities 31, 32 angularly offset from each other with reference to a rotation axis of the distribution body 28.

The first and second cavities 31, 32 (FIG. 7A) are placed on the distribution body 28 so that, in the engagement conditions between the latter and the body 24 (insertion inside the housing seat 25), and the first and second channels 29, 30 are suitable for fluidically connecting with the first and second passages 26 and 27. The distribution body 28, following a rotation inside the housing seat 25, is configured to selectively define the introduction, expansion and discharge conditions of the volumetric expander 4 and therefore define the movement of the active element 6, particularly of the piston 23, inside the jacket 5. During the condition of introducing the working fluid inside the expansion chamber 7, there is a predetermined positioning of the first and second cavities 31, 32. Particularly, during such condition, the first cavity 31 defines an intake opening 31*a* (FIG. 7A) facing the inlet of the jacket 5: with a certain and predetermined position of rotation of the distribution body 28, the intake opening 31*a* moves in front of the first passage 26, particularly the inlet 8. In this same introduction condition, the second cavity 32 defines a discharge opening 32*a* (FIG. 7A) facing the outlet 9 of the jacket 5 opposed to the second passage 27, particularly the outlet 9. Instead, in the discharge condition, the intake opening 31*a* faces away from the jacket 5 by placing itself on the opposite part with respect to the first passage 26, particularly the inlet 8. In this same position of the body 28, its discharge opening 32*a* faces the jacket 5 fluidically communicating with the second passage 27, particularly the outlet 9. Therefore, during the rotation of the distribution body 28, the expansion chamber 7 of the cylinder 5 is fluidically communicating with the outside in an alternate way by the first and second cavities 31 and 32, particularly the respective openings 31*a* and 32*a*. For this reason, the working fluid at the gaseous state, flowing from the vaporizer 3, can enter the expansion chamber 7, by flowing through the housing seat 25, first channel 29, first cavity 31, first passage 26 and inlet 8 and flowing at the end inside the expansion chamber 7.

With reference to the exit path of the working fluid from the inside of the chamber 7 to the outside, it is obviously possible to implement a similar solution. From the inside of the chamber 7, the same working fluid can exit by successively flowing through the exit 9, second passage 27, second cavity 32, second channel 30. Moreover, means for commanding the distribution body 28 (rotative valve), are provided which when are combined with the arrangement, size and layout of the described elements, are suitable for causing, for each complete revolution of the main shaft 11, the intake opening 31*a* to rotate for a short interval, comprised in the same complete revolution, in front of the inlet in order to permanently communicate the chamber 7 of the jacket 5 with the vaporizer 3. In a successive interval of the same rotation, the distribution body 28 closes the inlet 8, and communicates the chamber 7 with the outlet 9. Substantially, the expansion chamber 7 alternately communicates with first and second passages 26 and 27 for introducing and discharging the working fluid, according to a sequence synchronized with the movement and position of the active element 6, and such sequences of opening/closing the inlet 8, and opening/closing the outlet 9 are commanded by, and are comprised in the same and only rotation of, the main shaft 11. Therefore, introducing a working fluid at the gaseous state at a suitable pressure, and under the above explained conditions, inside the expansion chamber 7, accomplishes a predetermined alternate or rotative movement of the active element 6 inside the jacket; such movement transforms such movement in a rotative movement of said shaft 11, which can be used for actuating an electric generator 12, as shown in the attached figures, consisting of a rotor, coupled to said main shaft 11, and a stator, per se known. Therefore, the electric generator 12 generates one or more electric voltages suitable for supplying, by convenient electric connections, not shown, the using devices which can have a wide variety of shapes, uses and types.

As previously said, the plant comprises a control unit 33; advantageously, such unit 33 is connected to the distribution body 28 and/or main shaft 11, and is configured to monitor the position and movement of the latter.

As it is visible in the attached figures, the plant 1 further comprises a regulation device 14 configured to enable to vary at least one of the following parameters: the duration of the introduction condition, the maximum passage cross-section of the inlet 8. Specifically, the regulation device 14 is suitable for managing the volumetric flow rate of the working fluid introducible into the expansion chamber 7, during the introduction condition. De facto, the regulation device 14 enables to manage the step of introduce the working fluid and therefore to regulate also the duration of the isobaric expansion step of the active element 6 (piston). Obviously, the regulations will depend on the size of the active element 6, and particularly on the total stroke of the latter inside the jacket. In a preferred embodiment of the invention, the regulation device 14 comprises at least one mask 15 moveable relative to the inlet 8 to enable to vary the maximum passage cross-section of the latter in order to determine the regulation of the volumetric flow rate of the working fluid entering the expansion chamber 7 during the introduction condition of the valve 10. More specifically, the mask 15 is interposed between the first cavity 31 of the distribution body 28 and first passage 26 of the valve 10: being the mask 15 moveable relatively to the first passage 26, particularly the inlet 8, it enables to vary the passage cross-section of the fluid through the first passage 26 and consequently to vary the volumetric flow rate of the working fluid entering the chamber 7.

The mask 15 comprises, in a non limiting way, a semi-cylindrical sleeve interposed between the housing seat and the distribution body 28. In this arrangement, the mask 15 is rotatively moveable around the rotation axis of the distribution body 28 for placing itself in a plurality of angular positions with respect to the first passage 26. The mask 15 can comprise a semi-cylindrical plate extending between a first and second terminal ends (as shown in the exploded view in FIG. 7): in such a condition, the variation of the passage cross-section will be determined by the position of said ends relatively to the first passage 26. Alternatively, the mask 15 can comprise at least one passage seat (such condition is not illustrated in the attached figures) having a predetermined shape: in such condition, the variation of the passage cross-section of the working fluid will be determined by the position of said seats with respect to the first passage 26.

Under both the above described conditions, it is possible to vary a predetermined degree of occlusion of the passage cross-section of the working fluid at the inlet 8. More particularly, the mask 15, following its own angular movement, determines a predetermined number of degrees of occlusion of the inlet 8; each occlusion degree is defined by the ratio of the area of the maximum cross-section of the inlet 8 without the mask 15, to the area of the maximum passage cross-section in the presence of the mask 15. The occlusion degree is comprised between 1 and 3, particularly between 1 and 2, still more particularly between 1 and 1.5. De facto, the movable mask 15 determines, based on the occlusion degrees, the point wherein the gas introduction step ends, which characterizes the successive expansion step. In the preferred illustrated embodiment, the mask 15 has a semi-circular shape; however, it is not excluded the possibility of using a plate-shaped mask extending along a prevalent extension plane and suitable for translating along a predetermined direction between the first passage 26 and first cavity 31.

As it is visible in FIGS. 8-13, the regulation device 14 further comprises an actuating device 43 operatively active on the mask 15, and configured to act on the latter and enable its movement. Advantageously, the actuating device 43 comprises at least one piston which two pressures act on: at a side, the evaporation pressure (the pressure at the inlet of the vaporizer), at the opposite side, the condensation pressure of the working fluid. In this latter described condition, the piston automatically displaces to the desired position based on the ratio between the pressures which is also the expansion ratio of the expander 4. Actually, such configuration enables to automatically regulate the position of the piston based on the expansion ratio of the volumetric expander 4 in order to define a dynamic regulation which is substantially "instant by instant". The attached figures illustrate a preferred embodiment of the actuating device 43 comprising, in a non limiting way, a pusher 44 engaged, at one side, with the body 24 of the valve 10, and at the another side with a terminal portion of the mask 15. The pusher 44 comprises, in a non limiting way, one or more screws configured to act on the terminal portions of the mask 15 following a relative rotation with respect to the body 24 of the valve 10. In the attached figures, it is shown a preferred embodiment, wherein the actuating device 43 comprises a first and second pushers 44, 45 (two pushers) for each mask 15 (FIGS. 8-11). The mask 15 can be manually regulated by mechanically acting on the pushers (screws). Preferably, such regulation (rotation of the mask 15) is automatically executed by a control unit 33. In this latter condition, it is possible to provide, for example, an electric motor or a pneumatic circuit or a hydraulic circuit (visible in FIG. 13, for example) suitable for acting for displacing the mask 15 whose management is given to the control unit 33.

To better understand the parameters effective for regulating the mask 15, it is useful to analyze the working cycle of the expander 4. De facto, the working fluid, during the introduction condition, is introduced in the expansion chamber 7 at a predetermined temperature set in the vaporizer 3. Further, the working fluid has a predetermined pressure substantially equal to the pressure of the working fluid exiting the pump 13 (maximum pressure of the circuit 2). Based on the characteristics of the fluid, such as for example, the pressure, temperature and volumetric flow rate, it is possible to obtain a predetermined thrust force on the active element and consequently a predetermined amount of obtainable work. Particularly, the obtainable work is given by the pressure difference between the inlet and the outlet of the expansion chamber 7 for the variable volume of the latter. The pressure of the working fluid entering the expander 4 is the maximum pressure the working fluid attains inside circuits 2 and depends on the characteristics of the pump 13: it is the pump 13 that determines the pressure jump. The pressure of the working fluid exiting the expander 4 is the discharge pressure. In order to maximize the obtainable work, the discharge pressure exiting the expander 4 must be substantially equal to the fluid condensation pressure, in other words, the pressure of the working fluid entering the pump 13, particularly inside the collecting tank 17. It is evident that the volume of the jacket 5 remains constant and consequently for maximizing the obtainable work it is necessary to maximize the pressure jump. As previously said, the maximum pressure in the circuit depends on the characteristic of the pump 13; instead, with reference to the minimum pressure (the condensation pressure) it is a variable parameter depending on the environmental atmospheric conditions.

In order to maximize the obtainable work, with the same maximum pressure suppliable by the pump 13, the discharge pressure at the outlet of expander 4 must be substantially equal to the minimum pressure. The purpose is to increase the power or efficiency of the whole plant. De facto, if at the bottom dead center (BDC) of the active element 6 the pressure of the working fluid (gas) is equal to the one in the condenser, the cycle will have the maximum efficiency because it is harnessed all the expansion step without releasing a surplus heat to the condenser and without having done a negative work in the downward stroke. On the contrary, if the pressure of the working fluid, at the BDC is greater than the one of the condensation, there is a potentially useful lost heat at the outlet of the expander which will be wasted (lost) at the condenser (there is a drop of the efficiency and a loss of power). De facto, if the discharge pressure of the working fluid exiting the expander is greater than the condensation pressure, there will be a waste of power equal to the difference between the latter two pressures.

Moreover, if the working fluid pressure will be less than the condensation pressure before the active element reaches the BDC, the active element 6 (piston) effects a negative work because the latter operates against the system from the position wherein the fluid pressure is equal to the condensation pressure to the BDC: such work is performed by the system on the active element 6 and represents a negative work phase which is subtracted from the overall cycle positive phase (reduction of the power suppliable by the plant 1).

The regulation device 14 is configured to enable to introduce, inside the expansion chamber 7, an amount of working fluid so that, at the end of the expansion condition, the discharge pressure of the latter is substantially equal to the condensation pressure of the working fluid (pressure of the working fluid at the liquid state entering the pump 13). De facto, the regulation device 14 is suitable for enabling the expander 4 to follow the trend of the condensation pressure in order to maximize the obtainable work. In order to perform a dynamic control on the discharge pressure of the expander 4, the plant 1 can use the control unit 33 which, by the sensors 34, 35, 39 and 40, can monitor the pressures and temperatures of the working fluid, and consequently, by means of a connection with the actuating device 43, command the mask 15.

Working Fluid Advantageously, the working fluid used inside the plant 1, comprises at least one organic fluid (ORC fluid). Preferably, the working fluid comprises an amount of organic fluid comprised between 90% and 99%, particularly between 95% and 99%, still more particularly about 98%. The use of an organic fluid is particularly advantageous for the plant due to the excellent capacity of transferring heat from a hot source to a cold source. The organic fluid is mixed with at least an oil configured to enable to lubricate the movable elements of the expander 4 (active element 6); the presence of the oil enables to further improve the sealing and a proper operation of the exchangers. For example, the used organic fluids can comprise at least one selected among the group of the following fluids: R134A, 245FA, R1234FY, R1234FZ.

Process for Producing Electric Power

Moreover, it is an object of the present invention a process for converting thermal power in electric power.

The process comprises a step of circulating the working fluid, whose movement is imparted by the pump 13. The working fluid, propelled by the pump 13, arrives into the vaporizer 3 which, due to the hot source H, heats the working fluid until it is evaporated (condition shown by the scheme in FIG. 1). The pressure jump imposed by the pump 13 is substantially the jump required by the cycle as a function of the working conditions. In other words, the pump 13 is supplied by the fluid at the liquid state at the condensation pressure except for the under-cooling. The pressure at the outlet depends on the evaporation pressure which is equal to the evaporation pressure of the working fluid, in other words depends on the temperature of the hot source except for the superheating. The mass flow rate of the working fluid depends on the available thermal power and on the set superheating. The process can comprise additional steps of heating the fluid before the vaporizing steps. Particularly, the process can comprise a step of recovering the heat by the economizer 36: such step enables to heat the working fluid exiting the pump by the working fluid exiting the expander. Moreover, the process can comprise a step of preheating the working fluid exiting the economizer 36 by a third heat exchanger 18. The preheating step enables to heat the working fluid without causing the evaporation of the latter. The preheating heat is withdrawn from the hot source H, exiting the vaporizer 3. In order to correctly optimize the process, it is possible to size the vaporizer 3 and pre-heater 18 so that they can respectively operate under a heat exchange between fluid/gas and fluid/fluid.

After the vaporizing step, the working fluid at the gaseous state flows into the volumetric expander 4: the working fluid consecutively flows through the housing seat 25 of valve 10, first channel 29, first cavity 31, opening 31*a*, first passage 26, inlet 8 until it flows into the expansion chamber 7: such steps determining the working fluid introduction condition. After the introduction step, the expander determines the expansion step (the inlet 8 and outlet 9 are closed and ensuing expansion of the fluid) due to the greater pressure. Due to such expansion, the active element 6 is biased to alternately (alternate expander) or rotatively (rotative expander) move, which is per se known, by putting therefore in rotation the main shaft 11 and ultimately actuates said electric generator 12. The gas flow is therefore expelled from the expansion chamber 7 through the outlet 9, second passage 27, opening 32*a*, second channel 30 until it exits the body 24 of valve 10.

The process comprises a step of regulating the volumetric flow rate of the working fluid entering the expansion chamber 7 by the regulation device.

The regulation step comprises a step of controlling the evaporation and condensation pressures by the sensors 34 and 35: such sensors send a respective command signal to the control unit 33 which is suitable for processing the signal and determining such pressures. Once the evaporation and condensation pressures have been determined, it is possible to act on the regulation device 14 to determine a discharge pressure of the expander substantially equal to the condensation pressure. More particularly, the regulation step provides to move the mask 15, by the actuating element 43, with respect to the inlet 8 in order to vary the through cross-section of the working fluid for determining the right volumetric flow rate which enables to obtain a discharge pressure equal to the condensation pressure (maximization of the obtainable work). From there, the same circuit 2 conveys the working fluid in the condenser 16 where such fluid is condensed and supplied to the collecting tank 17. The tank 17 fluidically communicates with the pump 13 which withdraws directly from said tank so that the working fluid again circulates in the circuit. More particularly, the collecting tank 17 is interposed between the condenser 16 and pump 13 and enables to collect the working fluid at the liquid state: in such a condition, the tank 17 enables the pump 13 to suction the fluid without suctioning possible air bubbles in order therefore to ensure a continuous supply of the liquid.

The solution of the electric generation plant 1 can be advantageously harnessed under circumstances and in environments which are very different; for example, the hot supply source "H" can be an industrial discharge, while the heat exchanger can use a cold source "C" consisting for example in a watercourse, or an ambient air condenser (case illustrated in FIG. 2), if there are the conditions.

ADVANTAGES OF THE INVENTION

The advantage of the above described solution consists in that the distribution body 28 shows some remarkable and undisputable advantages over the standard distribution by stem valves, which are:

- very high reliability;
- the involved parts are not worn, and therefore the maintenance is very limited;
- it is not necessary a calibration;
- a reduced energetic absorption since it is produced and used just a rotative movement.

Further, the fact that the distribution body 28 can rotate synchronously with the movement of the active element causes the vaporizer 3 to communicate with the inlet 8, particularly with the expansion chamber in a predetermined position of this element, typically when it reaches anticipated or retarded angles with respect to the upper dead center, which depend on the ratio between the operative pressures, and the chamber is closed after a predetermined fraction of time, before the active element reaches the bottom dead center; a similar situation, although obviously inverted, must be fulfilled also with reference to the opening and closure of the discharge opening 11. So, the main shaft 11 is connected to the distribution body 28 by an assembly of kinematic elements comprising, for example, gears, pinions, idle wheels, suitable for acting on the distribution body 28 in order to ensure the above described conditions. Since the main shaft 11 rotates a complete revolution with a double downward and upward stroke of the actuating element, it will suffice to implement said kinematic elements so that one revolution of the main shaft 11 corresponds to just one revolution of the distribution body, which in turn causes both an opening and closure of the introduction path through the inlet 8, and a successive opening and closure of the discharge path through the outlet 9.

Further, the fact of varying the discharge pressure of the working fluid exiting the expander 4 enables to make available a plant adaptable to different working conditions and consequently suitable for operating in a wide range of operative conditions.

De facto, the possibility of regulating the through cross-section of the working fluid entering the expansion chamber 7 enables to maximize the obtainable work and therefore ensures a certain operability of the plant 1 also under conditions of low thermal available power (a hot source H at a medium/low temperature).

The invention claimed is:

1. A closed cycle plant for converting thermal power into electric power comprising:

a closed circuit, inside which at least one working fluid according to a predetermined circulation direction circulates, at least one volumetric expander configured to receive at the inlet the working fluid at the gaseous state, said volumetric expander comprising:

(i) at least one jacket having at least one inlet and one outlet respectively suitable for introducing and discharging the working fluid, (ii) an active element housed in said jacket and suitable for defining, in cooperation with said jacket, a variable volume expansion chamber, (iii) a main shaft associated to the active element and configured to rotatively move around an axis, (iv) at least one valve, active on the inlet and outlet of the jacket, and configured to selectively open and close said inlet and said outlet to allow at least one condition of introducing, one condition of expanding and one condition of discharging the working fluid from said expansion chamber, at least one electric energy generator connected to the main shaft, the valve comprising at least one regulation device configured to allow the variation of the at least one of the following parameters:

(i) the duration of the introduction condition, and (ii) the maximum passage cross-section of the inlet, wherein the plant further comprises:

at least one pump placed on the circuit and arranged to impose to the working fluid said predetermined circulation direction, at least one first heat exchanger active on the circuit and located downstream of the pump with respect to the working fluid circulation direction, said first heat exchanger being arranged for receiving at the inlet the working fluid and being configured to receive heat from a hot source and allow the heating of the working fluid until it is caused the passage from the liquid state to the gaseous one, said volumetric expander being connected downstream of the first heat exchanger, with respect to the working fluid circulation direction inside the circuit, and being configured to receive at the inlet the working fluid at the gaseous state generated in the first exchanger, wherein the regulation device comprises at least one mask movable relatively to the inlet to allow the variation of the maximum cross-section and determine a regulation of the volumetric flow rate of the working fluid entering the expansion chamber during the introduction condition, wherein said regulation device comprises:

(i) at least one first sensor active on the circuit, and configured to generate a first detection signal regarding the at least one pressure parameter of the working fluid at the gaseous state, entering the volumetric expander, (ii) at least one second sensor active on the circuit and configured to generate a second detection signal regarding at least one pressure parameter of the working fluid at the liquid state upstream of the pump, and (iii) a control unit connected to the first and second sensors, and configured to:

(a) receive from the first and second sensors the respective first and second detection signals;

(b) process the signal received from the first and second sensors for determining the pressure of the working fluid respectively entering the volumetric expander and upstream of the pump; and (c) position the mask relatively to the inlet, as a function of at least one the values of said working fluid pressures.

2. The plant according to claim 1, wherein the valve comprises:

a valve body having at least one housing seat having a substantially cylindrical shape, the valve body of the valve further comprising at least one first and one second passages respectively arranged to put in fluid communication the housing seat with the inlet and the outlet of said expansion chamber, at least one distribution body rotatively engaged with the inside of the housing seat, and comprising:

(i) a first and second channels, and (ii) at least one first and one second cavities placed at a side wall of the distribution body and angularly offset from each other with respect to a rotation axis of the distribution body, said first and second cavities being configured to put in fluid communication the first and second channels respectively with the first and second passages, the distribution body, following the rotation inside the housing seat, being configured to selectively determine the introduction, expansion and discharge conditions of the volumetric expander, and wherein said mask is interposed between the first cavity of the distribution body, and the first passage of the valve, the mask being movable relative to the first passage for determining a variation of said maximum cross-section.

3. The plant according to claim 2, wherein the mask comprises a semi-cylindrical sleeve interposed between the housing seat and the distribution body, the mask being rotatively movable around the rotation axis of the distribution body, and wherein an angular movement of the mask determines a predetermined number of occlusion degrees of the inlet, each occlusion degree being defined by the ratio of the area of the inlet maximum cross-section without the mask, to the area of the maximum passage cross-section in the presence of the mask, said occlusion degree being comprised between 1 and 3.

4. The plant according to claim 1, wherein said regulation device comprises at least one first pusher connected, at one side, to a terminal portion of the mask, and at another side, to the valve body, said pusher being configured to move relatively to the valve body for displacing the mask, relatively to the inlet, into a plurality of operative positions, and wherein the regulation element comprises at least one second pusher connected, at one side, to a terminal portion of the mask and at another side to the valve body, said second pusher being placed on the opposite side with respect to the first pusher with respect to the mask, and being configured to define a blocking condition of the mask following the displacement of the latter in a predetermined operative position.

5. A plant according to claim 4, wherein each of said first and second pushers comprises at least one screw arranged to push the mask at a terminal end following a relative rotation of the screw with respect to the valve body.

6. The plant according to claim 4, wherein at least one of said first and second pushers comprises a hydraulic or pneumatic actuator connected to the control unit, said control unit being configured to send a command signal to the actuator for determining a relative displacement of the mask with respect to the inlet.

7. The plant according to claim 1, wherein the volumetric expander comprises an alternate volumetric expander, wherein the expansion chamber has a hollow cylindrical seat, while the active element comprises a piston counter-shaped to the seat of the expansion chamber and slidingly moveable inside the latter, or wherein the volumetric expander is a rotative volumetric expander, wherein the expansion chamber has a seat having an epitrochoidal shape with at least two lobes, while the active element comprises a piston rotatively movable inside the seat.

8. The plant according to claim 1 further comprising:

at least one second heat exchanger active on the circuit and interposed between the expander and pump, said second heat exchanger being arranged for receiving through the working fluid exiting from said expander, said second heat exchanger being configured to communicate with a cold source and enable to condensate the working fluid until it is caused the complete passage from the gaseous state to the liquid one, and at least one collecting tank active on circuit and interposed between the pump and second exchanger, said collecting tank being configured to contain the working fluid at the liquid state exiting said second exchanger, the pump being connected to the collecting tank and being suitable for supplying the working fluid at the liquid state, towards the first heat exchanger.

9. The plant according to claim 1 further comprising at least one third heat exchanger operatively active on the circuit upstream of the first heat exchanger and suitable for receiving through said working fluid, said third heat exchanger being further configured to receive heat from a hot source and enable to pre-heat the working fluid before the latter is introduced in the first heat exchanger.

10. The plant according to claim 9, wherein said third heat exchanger is configured to pre-heat the working fluid until a saturated liquid condition, and wherein said first heat exchanger is suitable for receiving the working fluid in a saturated liquid condition and for supplying at the outlet the working fluid in a saturated vapor condition, and wherein said first and third heat exchangers are positioned immediately and consecutively after each other according to the working fluid circulation direction, said first and third heat exchangers being configured to receive heat from the same hot source, said plant comprising a heating circuit extending between and inlet and an outlet and inside which at least one heating fluid from said hot source is suitable for circulating, said first and third heat exchangers being operatively active on the heating circuit, and interposed between the inlet and outlet of said circuit, the heating fluid, circulating from the inlet towards the outlet, consecutively flowing through the first and third heat exchangers.

11. A closed cycle plant for converting thermal power into electric power comprising:

a closed circuit, inside which at least one working fluid according to a predetermined circulation direction circulates, at least one volumetric expander configured to receive at the inlet the working fluid at the gaseous state, said volumetric expander comprising:

(i) at least one jacket having at least one inlet and one outlet respectively suitable for introducing and discharging the working fluid, (ii) an active element housed in said jacket and suitable for defining, in cooperation with said jacket, a variable volume expansion chamber, (iii) a main shaft associated to the active element and configured to rotatively move around an axis, (iv) at least one valve, active on the inlet and outlet of the jacket , and configured to selectively open and close said inlet and said outlet to allow at least one condition of introducing, one condition of expanding and one condition of discharging the working fluid from said expansion chamber, at least one electric energy generator connected to the main shaft, the valve comprising at least one regulation device configured to allow the variation of the at least one of the following parameters:

(i) the duration of the introduction condition, (ii) the maximum passage cross-section of the inlet, wherein the regulation device comprises at least one mask movable relatively to the inlet to allow the variation of the maximum cross-section and determine a regulation of the volumetric flow rate of the working fluid entering the expansion chamber during the introduction condition, wherein the valve comprises:

(i) a valve body having at least one housing seat having a substantially cylindrical shape, the valve body of the valve further comprising at least one first and one second passages respectively arranged to put in fluid communication the housing seat with the inlet and the outlet of said expansion chamber, (ii) at least one distribution body rotatively engaged with the inside of the housing seat, and comprising:

(a) a first and second channels, (b) at least one first and one second cavities placed at a side wall of the distribution body and angularly offset from each other with respect to a rotation axis of the distribution body, said first and second cavities being configured to put in fluid communication the first and second channels respectively with the first and second passages, the distribution body, following the rotation inside the housing seat, being configured to selectively determine the introduction, expansion and discharge conditions of the volumetric expander, and wherein said mask is interposed between the first cavity of the distribution body, and the first passage of the valve, the mask being movable relative to the first passage for determining a variation of said maximum cross-section, wherein the mask comprises a semi-cylindrical sleeve interposed between the housing seat and the distribution body, the mask being rotatively movable around the rotation axis of the distribution body, and wherein the mask, following its own angular movement, determines a predetermined number of occlusion degrees of the inlet, each occlusion degree being defined by the ratio of the area of the inlet maximum cross-section without the mask, to the area of the maximum passage cross-section in the presence of the mask, said occlusion degree being comprised between 1 and 3.

12. The plant according to claim 11 further comprising:

at least one pump placed on the circuit and arranged to impose to the working fluid said predetermined circulation direction, at least one first heat exchanger active on the circuit and located downstream of the pump with respect to the working fluid circulation direction, said first heat exchanger being arranged for receiving at the inlet the working fluid and being configured to receive heat from a hot source and allow the heating of the working fluid until it is caused the passage from the liquid state to the gaseous one, said volumetric expander being connected downstream of the first heat exchanger, with respect to the working fluid circulation direction inside the circuit, and being configured to receive at the inlet the working fluid at the gaseous state generated in the first exchanger.

13. The plant according to claim 12, wherein said regulation device comprises:

at least one first pusher connected, at one side, to a terminal portion of the mask, and at another side, to the valve body, said pusher being configured to move relatively to the valve body for displacing the mask, relatively to the inlet, into a plurality of operative positions, and wherein the regulation element comprises at least one second pusher connected, at one side, to a terminal portion of the mask and at another side to the valve body, said second pusher being placed on the opposite side with respect to the first pusher with respect to the mask, and being configured to define a blocking condition of the mask following the displacement of the latter in a predetermined operative position.

14. The plant according to claim 13, wherein each of said first and second pushers comprises at least one screw arranged to push the mask at a terminal end following a relative rotation of the screw with respect to the valve body.

15. The plant according to claim 13, wherein at least one of said first and second pushers comprises a hydraulic or pneumatic actuator connected to the control unit, said control unit being configured to send a command signal to the actuator for determining a relative displacement of the mask with respect to the inlet.

16. The plant according to claim 11 comprising at least one third heat exchanger operatively active on the circuit upstream of the first heat exchanger and suitable for receiving through said working fluid, said third heat exchanger being further configured to receive heat from a hot source and enable to pre-heat the working fluid before the latter is introduced in the first heat exchanger.

17. The plant according to claim 16, wherein said third heat exchanger is configured to pre-heat the working fluid until a saturated liquid condition, and wherein said first heat exchanger is suitable for receiving the working fluid in a saturated liquid condition and for supplying at the outlet the working fluid in a saturated vapor condition, and wherein said first and third heat exchangers are positioned immediately and consecutively after each other according to the working fluid circulation direction, said first and third heat exchangers being configured to receive heat from the same hot source, said plant comprising a heating circuit extending between and inlet and an outlet and inside which at least one heating fluid from said hot source is suitable for circulating, said first and third heat exchangers being operatively active on the heating circuit, and interposed between the inlet and outlet of said circuit, the heating fluid, circulating from the inlet towards the outlet, consecutively flowing through the first and third heat exchangers.

18. A closed cycle plant for converting thermal power into electric power comprising:

a closed circuit, inside which at least one working fluid according to a predetermined circulation direction circulates, at least one volumetric expander configured to receive at the inlet the working fluid at the gaseous state, said volumetric expander comprising:

(i) at least one jacket having at least one inlet and one outlet respectively suitable for introducing and discharging the working fluid, (ii) an active element housed in said jacket and suitable for defining, in cooperation with said jacket, a variable volume expansion chamber, (iii) a main shaft associated to the active element and configured to rotatively move around an axis, (iv) at least one valve, active on the inlet and outlet of the jacket, and configured to selectively open and close said inlet and said outlet to allow at least one condition of introducing, one condition of expanding and one condition of discharging the working fluid from said expansion chamber, at least one electric energy generator connected to the main shaft, the valve comprising at least one regulation device configured to allow the variation of the at least one of the following parameters:

(i) the duration of the introduction condition, (ii) the maximum passage cross-section of the inlet, wherein the plant further comprises:

at least one pump placed on the circuit and arranged to impose to the working fluid said predetermined circulation direction, —at least one first heat exchanger active on the circuit and located downstream of the pump with respect to the working fluid circulation direction, said first heat exchanger being arranged for receiving at the inlet the working fluid and being configured to receive heat from a hot source (H) and allow the heating of the working fluid until it is caused the passage from the liquid state to the gaseous one, said volumetric expander being connected downstream of the first heat exchanger, with respect to the working fluid circulation direction inside the circuit, and being configured to receive at the inlet the working fluid at the gaseous state generated in the first exchanger, wherein the plant comprising at least one third heat exchanger operatively active on the circuit upstream of the first heat exchanger and suitable for receiving through said working fluid, said third heat exchanger being further configured to receive heat from a hot source and enable to pre-heat the working fluid before the latter is introduced in the first heat exchanger, wherein said third heat exchanger is configured to pre-heat the working fluid until a saturated liquid condition, and wherein said first heat exchanger is suitable for receiving the working fluid in a saturated liquid condition and for supplying at the outlet the working fluid in a saturated vapor condition, and wherein said first and third heat exchangers are positioned immediately and consecutively after each other according to the working fluid circulation direction, said first and third heat exchangers being configured to receive heat from the same hot source, said plant further comprising a heating circuit extending between and inlet and an outlet and inside which at least one heating fluid from said hot source is suitable for circulating, said first and third heat exchangers being operatively active on the heating circuit, and interposed between the inlet and outlet of said circuit, the heating fluid, circulating from the inlet towards the outlet, consecutively flowing through the first and third heat exchangers.

19. The plant according to the preceding claim 18, wherein the regulation device comprises at least one mask movable relatively to the inlet to allow the variation of the maximum cross-section and determine a regulation of the volumetric flow rate of the working fluid entering the expansion chamber during the introduction condition.

20. The plant according to claim 19, wherein said regulation device comprises at least one first pusher connected, at one side, to a terminal portion of the mask, and at another side, to the valve body, said pusher being configured to move relatively to the valve body for displacing the mask, relatively to the inlet, into a plurality of operative positions, and wherein the regulation element comprises at least one second pusher connected, at one side, to a terminal portion of the mask and at another side to the valve body, said second pusher being placed on the opposite side with respect to the first pusher with respect to the mask, and being configured to define a blocking condition of the mask following the displacement of the latter in a predetermined operative position.

21. The plant according to claim 20, wherein each of said first and second pushers comprises at least one screw arranged to push the mask at a terminal end following a relative rotation of the screw with respect to the valve body.

22. The plant according to claim 21, wherein at least one of said first and second pushers comprises a hydraulic or pneumatic actuator connected to the control unit, said control unit being configured to send a command signal to the actuator for determining a relative displacement of the mask with respect to the inlet.

* * * * *